US010571173B2

(12) United States Patent
Tanaka et al.

(10) Patent No.: US 10,571,173 B2
(45) Date of Patent: Feb. 25, 2020

(54) AIR CONDITIONING SYSTEM

(71) Applicant: Mitsubishi Electric Corporation, Tokyo (JP)

(72) Inventors: Kosuke Tanaka, Tokyo (JP); Takuya Matsuda, Tokyo (JP); Hiroaki Asanuma, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 16/088,471

(22) PCT Filed: Jun. 14, 2016

(86) PCT No.: PCT/JP2016/067635
§ 371 (c)(1),
(2) Date: Sep. 26, 2018

(87) PCT Pub. No.: WO2017/216861
PCT Pub. Date: Dec. 21, 2017

(65) Prior Publication Data
US 2019/0331375 A1 Oct. 31, 2019

(51) Int. Cl.
*F25B 47/02* (2006.01)
*F25B 49/02* (2006.01)

(52) U.S. Cl.
CPC ..... *F25B 47/02* (2013.01); *F25B 49/02* (2013.01); *F25B 2313/0292* (2013.01);
(Continued)

(58) Field of Classification Search
CPC ..... F25B 49/02; F25B 2313/02741; F25B 2313/0315; F25B 2313/02791;
(Continued)

(56) References Cited

U.S. PATENT DOCUMENTS

2007/0130978 A1* 6/2007 Honda ..... F25B 13/00 62/238.7
2007/0245752 A1* 10/2007 Honda ..... F25B 31/004 62/115
(Continued)

FOREIGN PATENT DOCUMENTS

JP 2012-167860 A 9/2012

OTHER PUBLICATIONS

International Search Report of the International Searching Authority dated Sep. 6, 2016 for the corresponding international application No. PCT/JP2016/067635 (and English translation).

*Primary Examiner* — Emmanuel E Duke
(74) *Attorney, Agent, or Firm* — Posz Law Group, PLC

(57) ABSTRACT

An air conditioning system includes a bypass passage and a cooling-heating switching mechanism. The bypass passage is configured to be at least a part of a flow passage connecting a third port to a refrigerant inlet of a compressor. A linear expansion valve opens and closes the bypass passage. The cooling-heating switching mechanism includes check valves and four-way valves. The four-way valve causes a refrigerant outlet of the check valve to communicate with one of the refrigerant inlet and a refrigerant outlet of the compressor. The four-way valve causes a refrigerant inlet of the check valve to communicate with one of the refrigerant inlet and the refrigerant outlet of the compressor and causes a port to communicate with the other of the refrigerant inlet and the refrigerant outlet.

11 Claims, 19 Drawing Sheets

(52) U.S. Cl.
CPC ..... *F25B 2313/02732* (2013.01); *F25B 2313/02741* (2013.01); *F25B 2313/02791* (2013.01); *F25B 2313/0315* (2013.01); *F25B 2600/2501* (2013.01)

(58) Field of Classification Search
CPC ..... F25B 2600/2501; F25B 2313/0292; F25B 2313/02732; B60H 1/00; B60H 1/00642; B60H 1/00814; B60H 1/00878; B60H 1/00899; B60H 1/00921
See application file for complete search history.

(56) References Cited

U.S. PATENT DOCUMENTS

| | | | | |
|---|---|---|---|---|
| 2012/0198879 | A1* | 8/2012 | Motomura | F25B 13/00 62/238.7 |
| 2013/0152613 | A1* | 6/2013 | Yamashita | F25B 9/006 62/129 |
| 2015/0292756 | A1* | 10/2015 | Takenaka | F25B 13/00 62/160 |

* cited by examiner

FIG.2

| | | COOLING | HEATING | DEFROSTING | STOP |
|---|---|---|---|---|---|
| FOUR-WAY VALVE | 101 | A | B | A | A/B |
| | 102 | A | B | B | B |
| LEV | 110 | CLOSED | CLOSED | FULLY OPEN | CLOSED |
| | 111 | SH CONTROL or SC CONTROL | SH CONTROL or SC CONTROL | CLOSED | CLOSED |
| COMPRESSOR | 10 | SET TEMPERATURE | SET TEMPERATURE | FIXED Hz | STOP |
| OUTDOOR FAN | 41 | ON | ON | OFF | OFF |
| INDOOR FAN | 21 | ON | ON | OFF | OFF |

A···(E-H COMMUNICATED, F-G COMMUNICATED)
B···(E-F COMMUNICATED, H-G COMMUNICATED)

FIG.9

| | | COOLING | HEATING | DEFROSTING | STOPPED |
|---|---|---|---|---|---|
| FOUR-WAY VALVE | 101 | A | B | A | A/B |
| | 102 | A | B | B | B |
| LEV | 110 | HIC OUTLET SH CONTROL | HIC OUTLET SH CONTROL | FULLY OPEN | CLOSED |
| | 111 | SH CONTROL or SC CONTROL | SH CONTROL or SC CONTROL | CLOSED | CLOSED |
| COMPRESSOR | 10 | SET TEMPERATURE | SET TEMPERATURE | FIXED Hz | STOPPED |
| OUTDOOR FAN | 41 | ON | ON | OFF | OFF |
| INDOOR FAN | 21 | ON | ON | OFF | OFF |

FIG.11

| | | COOLING | HEATING | DEFROSTING | STOPPED |
|---|---|---|---|---|---|
| FOUR-WAY VALVE | 101 | A | B | A | A/B |
| | 102 | A | B | B | B |
| LEV | 110 | HIC OUTLET SH CONTROL | HIC OUTLET SH CONTROL | FULLY OPEN | CLOSED |
| | 111 | SH CONTROL or SC CONTROL | SH CONTROL or SC CONTROL | CLOSED | CLOSED |
| | 111B | SH CONTROL or SC CONTROL | SH CONTROL or SC CONTROL | CLOSED | CLOSED |
| COMPRESSOR | 10 | SET TEMPERATURE | SET TEMPERATURE | FIXED Hz | STOPPED |
| OUTDOOR FAN | | ON | ON | OFF | OFF |
| INDOOR FAN | | ON | ON | OFF | OFF |

FIG.13

| | | COOLING | HEATING | DEFROSTING 1 | DEFROSTING 2 | STOPPED |
|---|---|---|---|---|---|---|
| FOUR-WAY VALVE | 101 | A | B | A | B | A/B |
| | 102 | A | B | B | B | B |
| | 105 | A | B | B | A | A |
| LEV | 110 | HIC OUTLET SH CONTROL | HIC OUTLET SH CONTROL | FULLY OPEN | FULLY OPEN | CLOSED |
| | 111 | SH CONTROL or SC CONTROL | SH CONTROL or SC CONTROL | CLOSED | CLOSED | CLOSED |
| | 111B | SH CONTROL or SC CONTROL | SH CONTROL or SC CONTROL | CLOSED | CLOSED | CLOSED |
| COMPRESSOR | 10 | SET TEMPERATURE | SET TEMPERATURE | FIXED Hz | FIXED Hz | STOPPED |
| OUTDOOR FAN | | ON | ON | OFF | OFF | OFF |
| INDOOR FAN | | ON | ON | OFF | OFF | OFF |

AIR CONDITIONING SYSTEM

CROSS REFERENCE TO RELATED APPLICATION

This application is a U.S. national stage application of PCT/JP2016/067635 filed on Jun. 14, 2016, the contents of which are incorporated herein by reference.

TECHNICAL FIELD

The present invention relates to air conditioning systems, and more particularly, to an air conditioning system configured to perform a defrosting operation of a heat exchanger.

BACKGROUND ART

A conventionally proposed refrigerant circuit for an air conditioning system isolates a part of an indoor heat exchanger and switches a four-way valve from a heating cycle to a cooling cycle with refrigerant in the isolated heat exchanger kept at high temperature and high pressure before the operation shifts from heating operation to a defrosting operation, thereby defrosting an outdoor heat exchanger. This refrigerant circuit improves indoor comfort during defrosting (for example, PTL 1: Japanese Patent Laying-Open No. 2012-167860).

CITATION LIST

Patent Literature

PTL 1: Japanese Patent Laying-Open No. 2012-167860

SUMMARY OF INVENTION

Technical Problem

However, a long extension pipe for refrigerant which connects an outdoor unit and an indoor unit to each other leads to a great amount of refrigerant filled in the refrigerant circuit, which may increase a response time of a refrigeration cycle during defrosting. This may lead to an increased defrosting time, decreasing the room temperature that has been heated. Also, the indoor heat exchanger operates as an evaporator, which may cause cold air on the indoor side to impair indoor comfort. Since the refrigerant circulates also through the indoor heat exchanger during the defrosting operation, noise may be heard indoors with an indoor fan stopped.

An object of the present invention is to provide an air conditioning system having a reduced defrosting time and reduced noise.

Solution to Problem

The present invention relates to an air conditioning system, which includes a compressor, a first heat exchanger, a second heat exchanger, a first expansion valve, a bypass passage, an on-off valve, and a cooling-heating switching mechanism. The compressor has an entrance portion for suctioning refrigerant and an exit portion for discharging the refrigerant. The first heat exchanger has a first port and a second port. The second heat exchanger has a third port and a fourth port. The first expansion valve is configured to change how the second port and the third port are communicated with each other. The bypass passage is configured to be at least a part of a flow passage connecting the third port to the entrance portion. The on-off valve is configured to open and close the bypass passage. The cooling-heating switching mechanism is connected to the entrance portion, the exit portion, the first port, and the fourth port.

The cooling-heating switching mechanism includes a first check valve, a second check valve, a first three-way valve, and a four-way valve. The first check valve has a first inlet and a first outlet, and the first inlet communicates with the first port. The second check valve has a second inlet and a second outlet, and the second outlet communicates with the first port. The first three-way valve is configured to cause the first outlet to communicate with one of the entrance portion and the exit portion of the compressor. The four-way valve is configured to cause the second inlet to communicate with one of the entrance portion and the exit portion of the compressor and cause the fourth port to communicate with the other of the entrance portion and the exit portion.

Advantageous Effects of Invention

The air conditioning system is configured to perform a defrosting operation of the outdoor heat exchanger with the indoor heat exchanger separated by the first check valve, the second check valve, the first three-way valve, and the four-way valve. This causes refrigerant to circulate between the outdoor heat exchanger and the compressor with high-temperature, high-pressure refrigerant held in the indoor heat exchanger during defrosting, reducing a defrosting time and also reducing noise during defrosting.

BRIEF DESCRIPTION OF DRAWINGS

FIG. 2 shows a relationship between an operation mode of an air conditioning system and a state in which a controller controls each component in Embodiment 1.

FIG. 9 shows a relationship between an operation mode of an air conditioning system and a state in which a controller controls each component in Embodiment 2.

FIG. 11 shows a relationship between an operation mode of an air conditioning system and a state in which a controller controls each component in Embodiment 3.

FIG. 13 shows a relationship between an operation mode of an air conditioning system and a state in which a controller controls each component in Embodiment 4.

DESCRIPTION OF EMBODIMENTS

Figure 1:
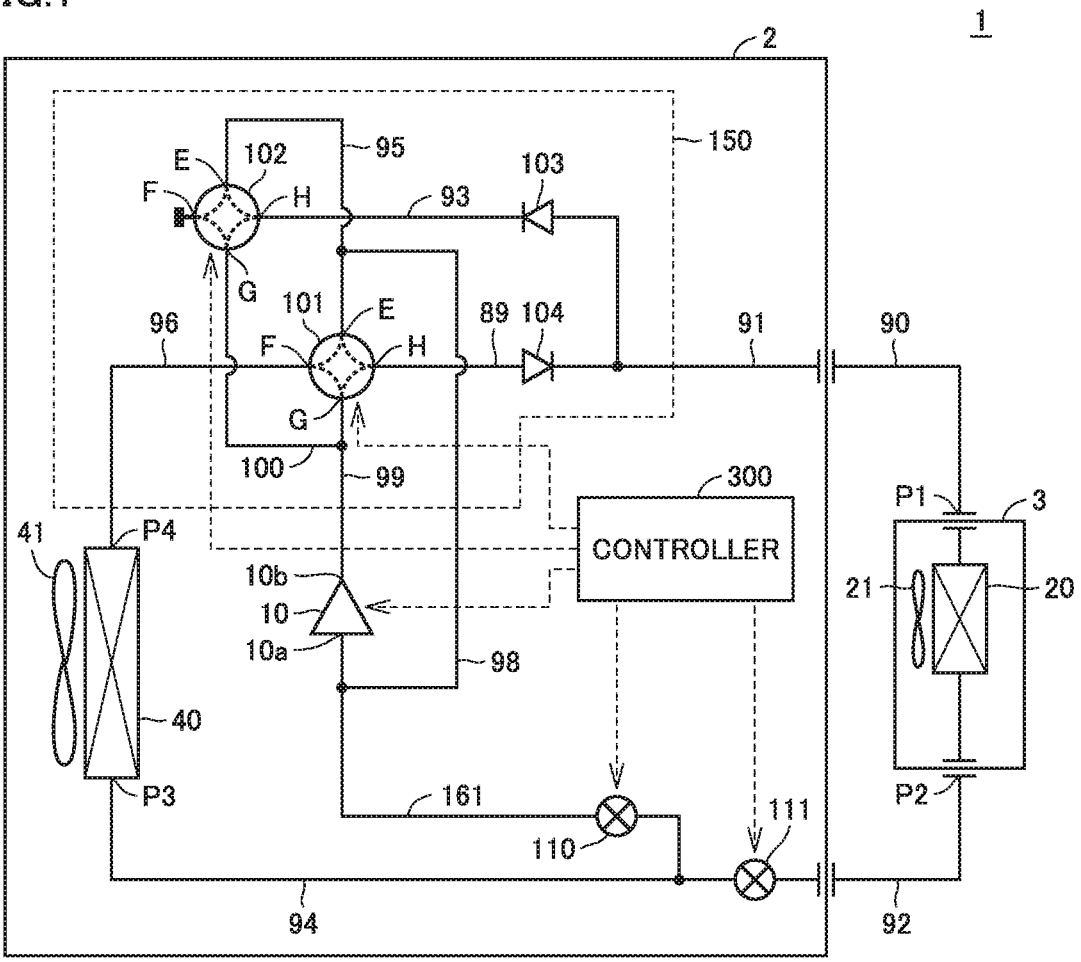
FIG. 1 shows a refrigerant circuit of an air conditioning system 1 according to Embodiment 1.

Embodiments of the present invention will be described below in detail with reference to the drawings. Although several embodiments will be described below, an appropriate combination of the configurations described in the respective embodiments has been intended at the time of application. The same or corresponding parts will be designated by the same reference numerals, and a description thereof will not be repeated.

Embodiment 1

FIG. 1 shows a refrigerant circuit of an air conditioning system 1 according to Embodiment 1. With reference to FIG. 1, air conditioning system 1 includes a compressor 10, an indoor heat exchanger 20, linear expansion valves (LEVs) 110 and 111, an outdoor heat exchanger 40, pipes 89 to 96 and 98 to 100, a bypass passage 161, four-way valves 101 and 102, and check valves 103 and 104. Each of four-way valves 101 and 102 has ports E to H. Four-way valve 102, port F of which is closed externally, functions as a three-way valve. Four-way valve 102 may be replaced by a three-way valve.

Pipe 89 connects port H of four-way valve 101 and the inlet of check valve 104 to each other. Pipe 93 connects port H of four-way valve 102 and the outlet of check valve 103 to each other. The outlet of check valve 104 and the inlet of check valve 103 are connoted together to one end of pipe 91. The other end of pipe 91 is connected to one end of pipe 90, which is an extension pipe outside of outdoor unit 2. The other end of pipe 90 is connected to a port P1 of indoor heat exchanger 20.

Pipe 92 connects a port P2 of indoor heat exchanger 20 and LEV 111 to each other. Pipe 94 connects LEV 111 and a port P3 of outdoor heat exchanger 40 to each other. Pipe 96 connects a port P4 of outdoor heat exchanger 40 and port F of four-way valve 101 to each other. A refrigerant outlet 10*b* and a refrigerant inlet 10*a* of compressor 10 are connected respectively to ports G and E of four-way valve 101. Pipe 99 is connected between refrigerant outlet 10*b* of compressor 10 and port G of four-way valve 101 and branches off to pipe 100 partway. Pipe 100 connects a branch point of pipe 99 and port G of four-way valve 102 to each other.

Pipe 95 connects port E of four-way valve 101 and port E of four-way valve 102 to each other. Pipe 95 branches off to pipe 98 partway. Pipe 98 connects a branch point of pipe 95 and refrigerant inlet 10*a* of compressor 10 to each other. Bypass passage 161 forms a part of a passage connecting pipe 94 and refrigerant inlet 10*a* of compressor 10 to each other, and LEV 110 is provided partway along bypass passage 161.

LEV 111 is disposed between pipe 92 and pipe 94 that connect port P2 of indoor heat exchanger 20 and port P3 of outdoor heat exchanger 40 to each other.

Air conditioning system 1 further includes a pressure sensor (not shown), a temperature sensor (not shown), and controller 300. Controller 300 controls compressor 10, four-way valves 101 and 102, LEVs 110 and 111, outdoor fan 41, and indoor fan 21 in response to operation command signals provided from a user and outputs from various sensors.

Controller 300 includes a central processing unit (CPU), a storage, and an input-output buffer, which are not shown, and controls four-way valves 101 and 102, compressor 10, LEVs 110 and 111, and the like in air conditioning system 1. This control is processed not only by software but also by dedicated hardware (electronic circuit).

Compressor 10 is configured to change an operation frequency in response to a control signal received from controller 300. Changing the operation frequency of compressor 10 adjusts an output of compressor 10. Compressor 10 may be of various types such as rotary type, reciprocating type, scroll type, and screw type.

Each of four-way valves 101 and 102 is controlled to enter any of a state A and a state B in response to a control signal received from controller 300. State A is a state in which port E and port H communicate with each other and port F and port G communicate with each other. State B is a state in which port E and port F communicate with each other and port H and port G communicate with each other.

In the present embodiment, four-way valves 101 and 102 and check valves 103 and 104 constitute a cooling-heating switching mechanism 150 that switches a flow direction of refrigerant between during cooling and during heating.

The degrees of opening of LEVs 110 and 111 are controlled to be fully open, perform superheat (SH: degree of superheating) control, perform subcool (SC: degree of supercooling) control, or be closed in response to a control signal received from controller 300.

FIG. 2 shows a relationship between an operation mode of an air conditioning system and a state in which a controller controls each component in Embodiment 1. Referring to FIGS. 1 and 2, first, in the cooling mode, both of tour-way valves 101 and 102 are set to state A, LEV 110 is closed, and LEV 111 is subjected to SH control or SC control. The operation frequency of compressor 10 is set in accordance with a set temperature, and both of outdoor fan 41 and indoor fan 21 are set to an ON (rotation) state.

Figure 3:
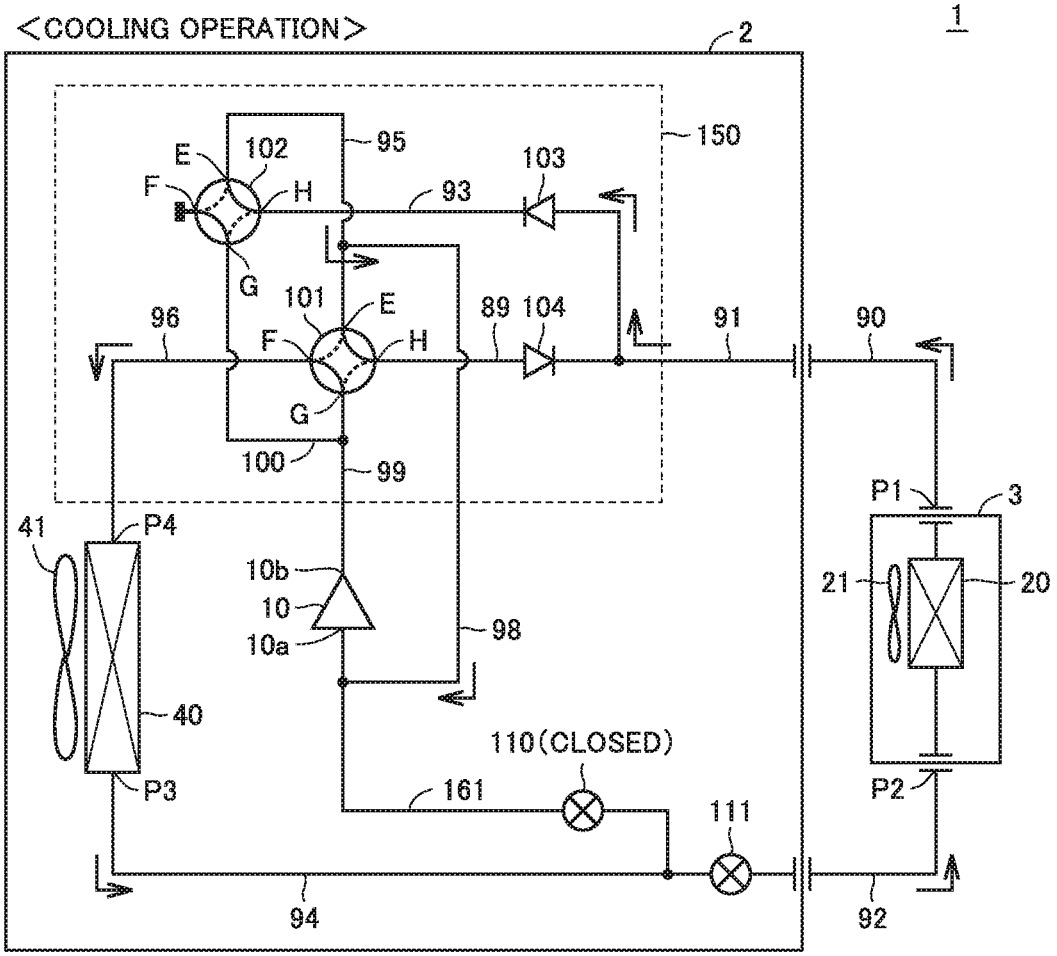
FIG. 3 shows a flow of refrigerant during a cooling operation.

FIG. 3 shows a flow of refrigerant during the cooling operation. With reference to FIGS. 2 and 3, compressor 10 suctions refrigerant from pipe 91 through check valve 103, pipe 93, four-way valve 102, pipe 95, and pipe 98, and compresses the refrigerant. The compressed refrigerant flows through four-way valve 101 to pipe 96.

Outdoor heat exchanger 40 (condenser) condenses the refrigerant that has flowed from compressor 10 through four-way valve 101 into pipe 96 and flows the condensed refrigerant to pipe 94. Outdoor heat exchanger 40 (condenser) is configured to perform heat exchange (heat dissipation) of high-temperature, high-pressure superheated steam (refrigerant) discharged from compressor 10 with outdoor air. The refrigerant condenses into liquid through this heat exchange. Outdoor fan 41 is arranged side by side with outdoor heat exchanger 40 (condenser), and controller 300 adjusts the rotation speed of outdoor fan 41 in response to a control signal. Changing the rotation speed of outdoor fan 41 can adjust a heat exchange amount per unit time between the refrigerant in outdoor heat exchanger 40 (condenser) and outdoor air.

LEV 111 decompresses the refrigerant that has flowed from outdoor heat exchanger 40 (condenser) to pipe 94. The decompressed refrigerant flows to pipe 92. LEV 111 is configured to adjust its degree of opening in response to a control signal received from controller 300. Changing the degree of opening of LEV 111 in a closed direction decreases a refrigerant pressure on the LEV 111 outlet side and increases the degree of dryness of the refrigerant. In contrast, changing the degree of opening of LEV 111 in an open direction increases a refrigerant pressure on the LEV 111 outlet side and decreases the degree of dryness of the refrigerant.

Indoor heat exchanger 20 (evaporator) evaporates the refrigerant that has flowed from LEV 111 to pipe 92. The evaporated refrigerant flows through pipes 90 and 91, check valve 103, pipe 93, four-way valve 102, and pipes 95 and 98 in order to refrigerant inlet 10*a* of compressor 10. Indoor heat exchanger 20 (evaporator) is configured to perform heat exchange (heat absorption) of refrigerant decompressed by LEV 111 with indoor air. The refrigerant evaporates into superheated steam through this heat exchange. Indoor fan 21 is arranged side by side with indoor heat exchanger 20 (evaporator). Controller 300 adjusts the rotation speed of indoor fan 21 by a control signal. Changing the rotation speed of indoor fan 21 can adjust a heat exchange amount per unit time between the refrigerant in indoor heat exchanger 20 (evaporator) and indoor air.

A heating mode will now be described. Referring again to FIG. 2, in the heating mode, both of four-way valves 101 and 102 are set to state B, LEV 110 is closed, and LEV 111 is subjected to SH control or SC control. Further, the operation frequency of compressor 10 is set in accordance with a set temperature, and both of outdoor fan 41 and indoor fan 21 are set to the ON (rotation) state.

Figure 4:
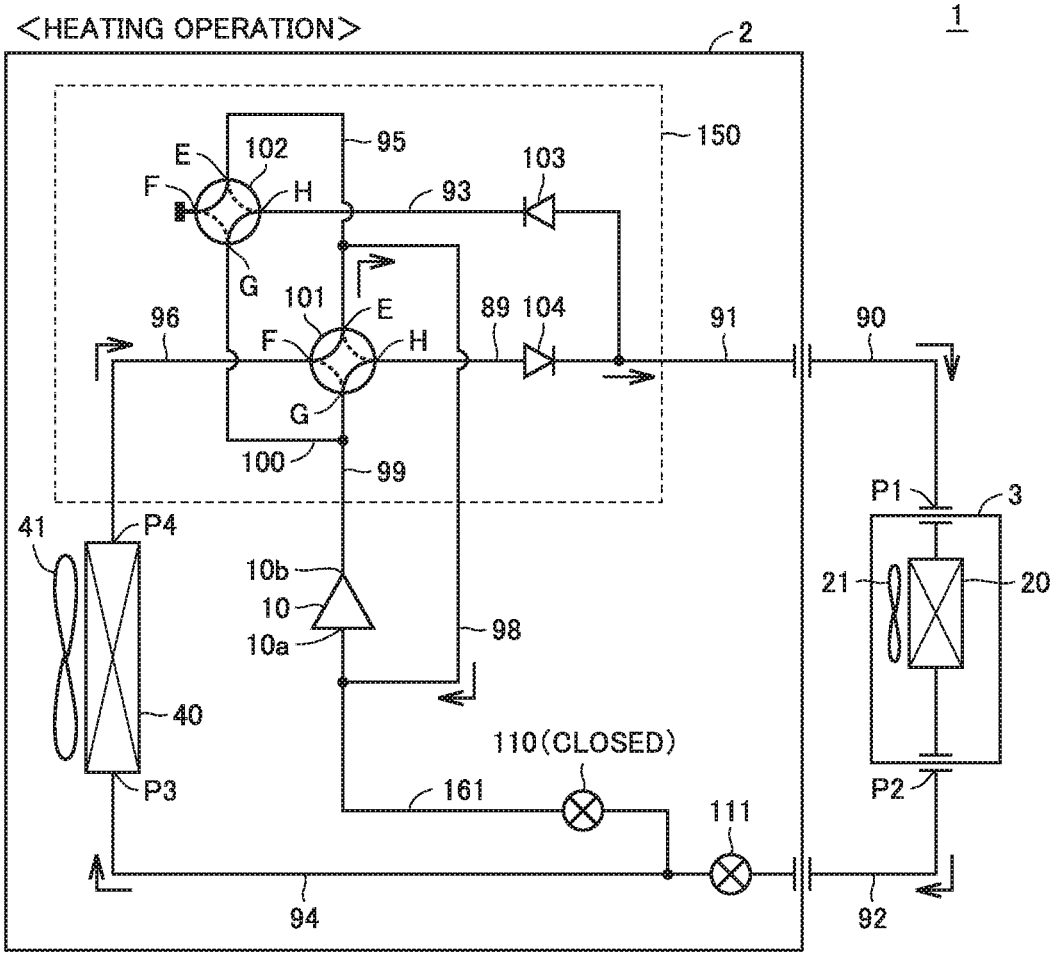
FIG. 4 shows a flow of refrigerant during a heating operation.

FIG. 4 shows a flow of refrigerant during the heating operation. With reference to FIG. 4, compressor 10 suctions refrigerant from pipe 96 through four-way valve 101, pipe 95, and pipe 98, and compresses the refrigerant. The compressed refrigerant flows through four-way valve 101, pipe 89, check valve 104, and pipe 91 in order to pipe 90.

Indoor heat exchanger 20 (condenser) condenses the refrigerant that has flowed from compressor 10 through four-way valve 101 and check valve 104 into pipe 90 and flows the condensed refrigerant to pipe 92. Indoor heat exchanger 20 (condenser) is configured to perform heat exchange (heat dissipation) of high-temperature, high-pressure superheated steam (refrigerant) discharged from compressor 10 with indoor air. The refrigerant condenses into liquid through this heat exchange. Controller 300 adjusts the rotation speed of indoor fan 21 in response to a control signal. Changing the rotation speed of indoor fan 21 can adjust a heat exchange amount per unit time between the refrigerant in indoor heat exchanger 20 (condenser) and indoor air.

LEV 111 decompresses the refrigerant that has flowed from outdoor heat exchanger 20 (condenser) to pipe 92. The decompressed refrigerant flows to pipe 94. LEV 111 is configured to adjust its degree of opening in response to a control signal received from controller 300. Changing the degree of opening of LEV 111 in the closed direction decreases a refrigerant pressure on the LEV 111 outlet side and increases a degree of dryness of the refrigerant. In contrast, changing the degree of opening of LEV 111 in the open direction increases a refrigerant pressure on the LEV 111 outlet side and decreases the degree of dryness of the refrigerant.

Outdoor heat exchanger 40 (evaporator) evaporates the refrigerant that has flowed from LEV 111 to pipe 94. The evaporated refrigerant flows through pipe 96, four-way valve 101, and pipe 98 to refrigerant inlet 10*a* of compressor 10. Outdoor heat exchanger 40 (evaporator) is configured to perform heat exchange (heat absorption) of the refrigerant decompressed by LEV 111 with outdoor air. The refrigerant evaporates into superheated steam through this heat exchange. Controller 300 adjusts the rotation speed of outdoor fan 41 in response to a control signal. Changing the rotation speed of outdoor fan 41 can adjust a heat exchange amount per unit time between the refrigerant in outdoor heat exchanger 40 (evaporator) and indoor air.

During the heating operation as described above, defrosting may be required due to frost formed on outdoor heat exchanger 40. It is conceivable in such a case that the operation may be switched once to the cooling operation to perform a defrosting operation of flowing high-temperature, high-pressure refrigerant through outdoor heat exchanger 40. However, switching to the cooling operation as shown in FIG. 3 changes indoor heat exchanger 20 from high pressure to low pressure. This needs time to return indoor heat exchanger 20 to high pressure again when heating is restarted, requiring time to restart the heating operation after defrosting.

In the technology described in Japanese Patent Laying-Open No. 2012-167860, a refrigerant circuit is proposed that includes an indoor heat exchanger divided. This refrigerant circuit isolates a part of the indoor heat exchanger and switches a four-way valve from the heating cycle to the cooling cycle with the refrigerant in the isolated heat exchanger kept at high temperature and high pressure before the operation shifts from heating to the defrosting operation, and then defrosts the outdoor heat exchanger, thus improving indoor comfort during defrosting. If an extension pipe connecting the indoor heat exchanger and the outdoor heat exchanger is long, however, even such a configuration leads to a longer time constant indicating a response speed of the refrigeration cycle during defrosting due to a large amount of filled refrigerant, which may increase a defrosting time.

In the present embodiment, thus, bypass passage 161 and LEV 110 are provided, and the defrosting operation is performed with indoor heat exchanger 20 separated from outdoor heat exchanger 40 and compressor 10 by LEV 111, four-way valve 102, and check valves 103 and 104. This causes the refrigerant to circulate by bypassing indoor heat exchanger 20 and extension pipes 90 and 92 during the defrosting operation, and keeps the refrigerant in indoor heat exchanger 20 and the refrigerant in extension pipes 90 and 92 at high temperature and high pressure during the defrosting operation. This leads to a reduced defrosting operation time, suppressing a decrease in room temperature during the defrosting operation. Also, since refrigerant suitable for each of the condenser and the evaporator is maintained after the completion of defrosting, fast startup is achieved when heating is restarted.

Figure 5:
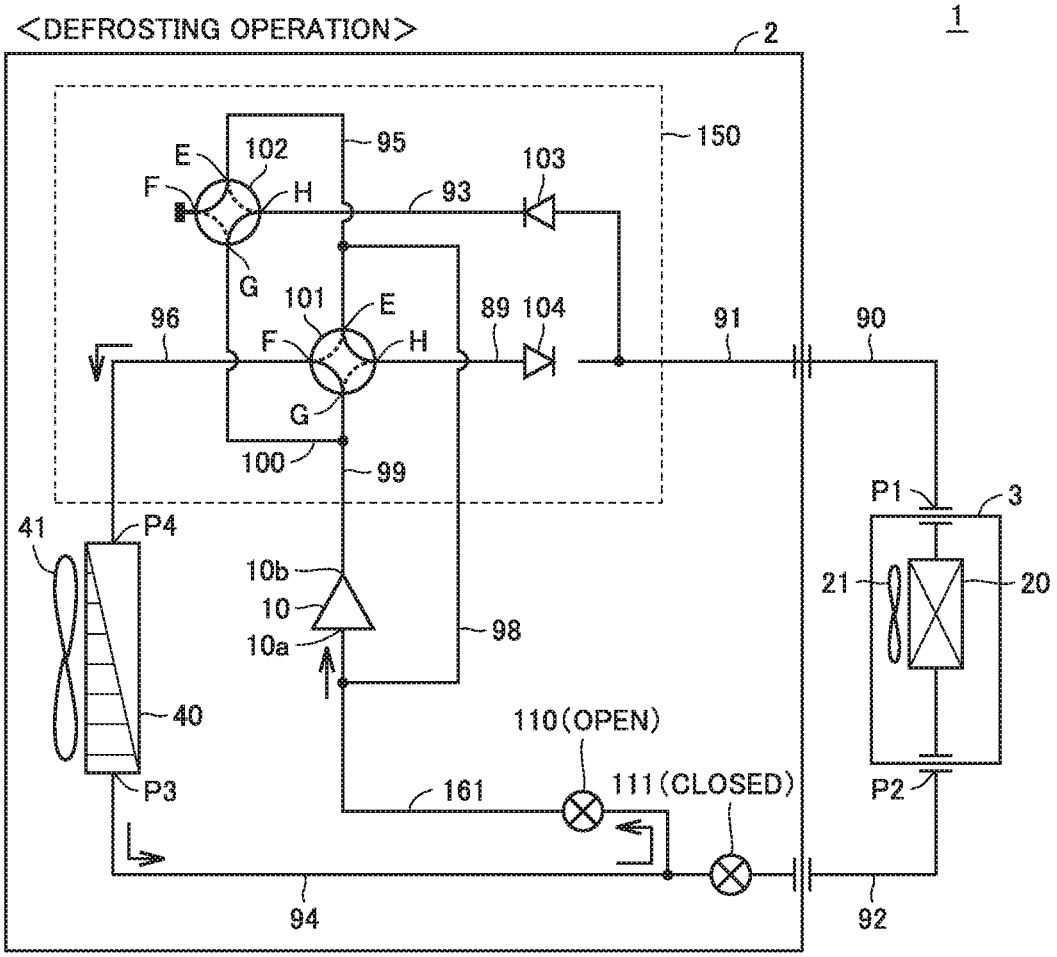
FIG. 5 shows a flow of refrigerant during a defrosting operation.

A flow of refrigerant during the defrosting operation will now be described with reference to the drawings. FIG. 5 shows a flow of refrigerant during the defrosting operation. Referring to FIGS. 2 and 5, in the defrosting mode, four-way valve 101 is set to state A, four-way valve 102 is set to state B, LEV 110 is set to be fully open, and LEV 111 is closed. Further, the operation frequency of compressor 10 is set to a predetermined fixed frequency, and both of outdoor fan 41 and indoor fan 21 are set to the OFF (stopped) state.

Compressor 10 suctions refrigerant from bypass passage 161 and compresses the refrigerant. The refrigerant that has been compressed to have high temperature and high pressure flows through four-way valve 101 to pipe 96.

Outdoor heat exchanger 40 (condenser) condenses the refrigerant that has flowed from compressor 10 through four-way valve 101 into pipe 96 and flows the condensed refrigerant to pipe 94. In outdoor heat exchanger 40 (condenser), heat exchange (heat dissipation) is performed between the high-temperature, high-pressure superheated steam (refrigerant) discharged from compressor 10 and the formed frost. The refrigerant is condensed into liquid through this heat exchange.

Since LEV 110 is fully open, the refrigerant that has flowed through outdoor heat exchanger 40 flows through LEV 110 into bypass passage 161. In order to prevent fluid backflow during defrosting, an accumulator that separates liquid refrigerant from refrigerant may be provided at refrigerant inlet 10*a* of compressor 10.

In contrast, since LEV 111 is controlled to be fully closed, refrigerant does not flow into indoor heat exchanger 20. Since the heating operation shown in FIG. 4 has been performed immediately before the defrosting operation, high-pressure refrigerant before being decompressed by LEV 111 is kept to be held in indoor heat exchanger 20 and pipes 90 and 92. In the defrosting operation of FIG. 5, the inlet side of check valve 104 is connected to the low-pressure side of compressor 10, and the outlet side of check valve 103 is connected to the high-pressure side of compressor 10, so that refrigerant does not pass through any of check valves 103 and 104.

A decrease in time constant achieves an effect of reducing a defrosting time. The time constant will now be described briefly.

A time constant $\tau$ (s) indicating a response speed of the refrigeration cycle is expressed by Equation (1) below, where Mr represents a refrigerant amount (kg) in a circulation path, and Gr represents a circulation flow rate (kg's) of the refrigerant.

$$\tau = Mr/Gr \quad (1)$$

That is to say, during the defrosting operation, bypass passage 161 causes refrigerant to bypass indoor heat exchanger 20 and extension pipes 90 and 92 when the refrigerant circulates, leading to a decrease in refrigerant amount Mr in the refrigerant path. In contrast, since a circulation amount Gr, which depends on the performance of compressor 10, is the same, time constant $\tau$ decreases as refrigerant amount Mr decreases. This achieves an effect of reducing a defrosting time. During defrosting, no refrigerant flows through indoor heat exchanger 20, resulting in an effect of reducing indoor cold air during defrosting.

Although indoor fan 21 is OFF in FIG. 2, indoor fan 21 may be rotated, for example, to blow a breeze because the refrigerant inside indoor heat exchanger 20 is high-temperature, high-pressure refrigerant. LEV 110 may be a fixed restriction mechanism. For variable restriction, LEV 110 is used more preferably because liquid flowback can be reduced.

The air conditioning system according to the present embodiment can also achieve an effect of fast startup also when heating is started or cooling is started after the operation has been stopped. The state in which an operation is stopped will now be described.

Figure 6:
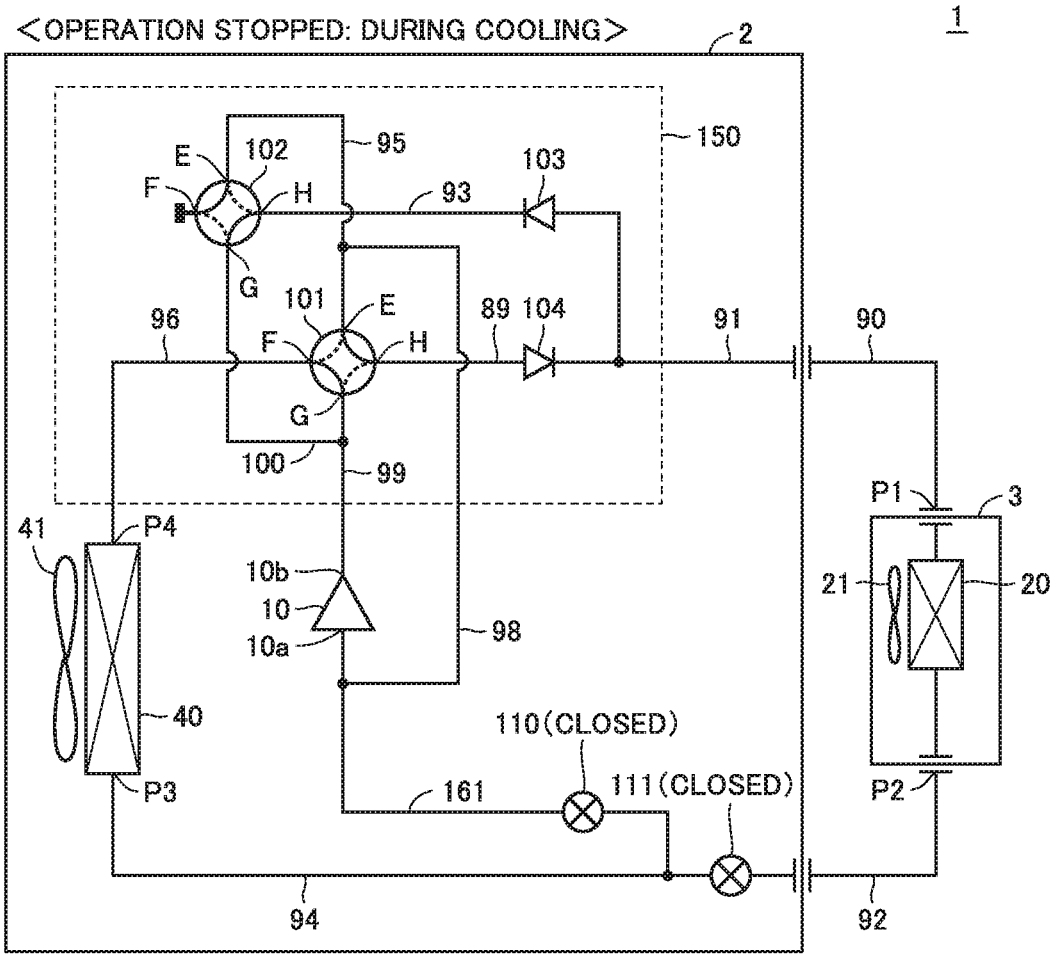
FIG. 6 shows a state in which an operation is stopped during cooling.
Figure 7:
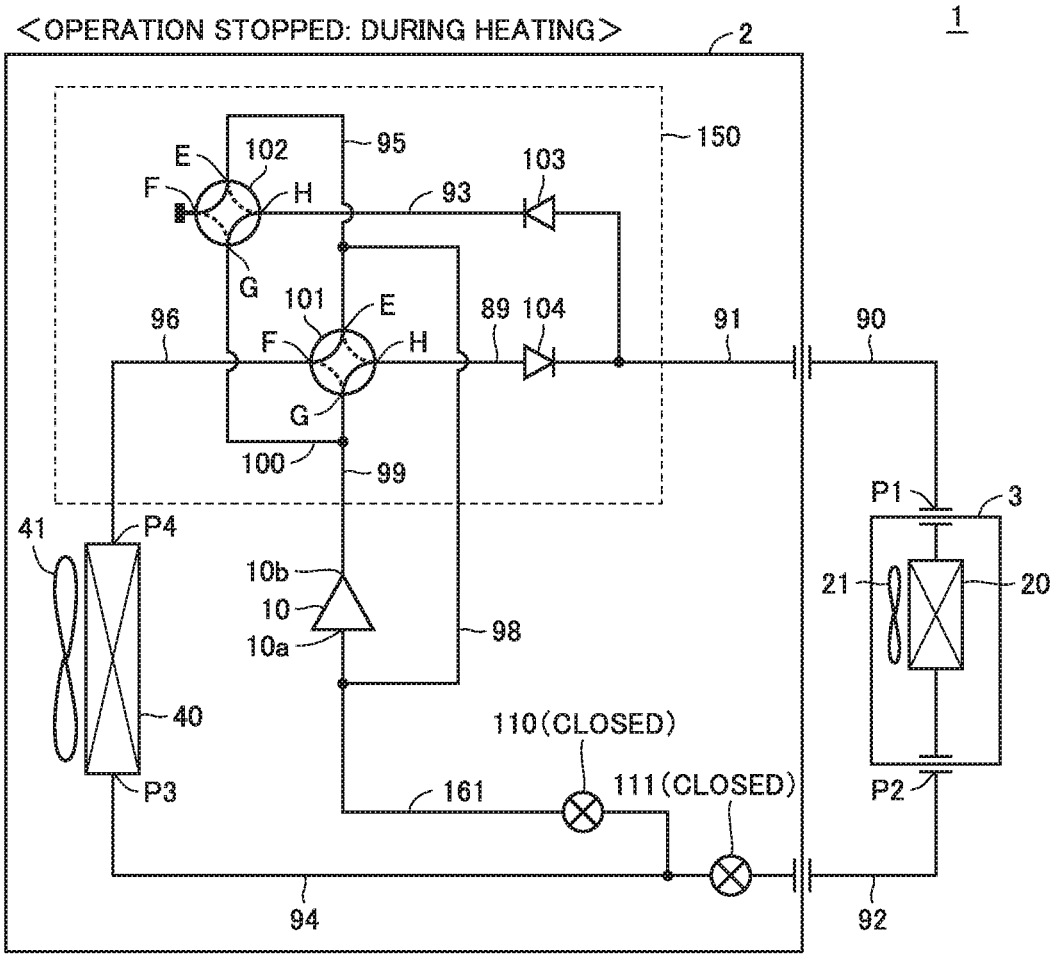
FIG. 7 shows a state in which an operation is stopped during heating.

FIG. 6 shows a state in which an operation is stopped during cooling. FIG. 7 shows a state in which an operation is stopped during heating.

Referring to FIGS. 2 and 6, with the operation stopped during cooling, four-way valve 101 is set to state A, four-way valve 102 is set to state B, and both of LEVs 110 and 111 are closed. All of compressor 10, outdoor fan 41, and indoor fan 21 are set to the OFF (stopped) state.

If cooling of FIG. 3 has been performed immediately before this state, refrigerant pressure is high in outdoor heat exchanger 40 and is low in indoor heat exchanger 20. When the state transitions from FIG. 3 to FIG. 6, switching of four-way valve 102 applies a reverse pressure to check valve 103, and LEV 111 is closed. Since LEV 110 is closed and check valve 104 is separated from the high pressure portion of outdoor heat exchanger 40 by compressor 10, a flow of refrigerant stops upon the pressure of bypass passage 161 decreasing to a pressure equal to the pressure of indoor heat exchanger 20. While the operation is stopped, the refrigerant pressure of outdoor heat exchanger 40 thus remains unchanged, and cooling can be started immediately. From the viewpoint of reducing a leakage of refrigerant pressure from outdoor heat exchanger 40 to indoor heat exchanger 20 as much as possible, a valve is preferably operated from the downstream side of the refrigerant flow. Specifically, preferably, LEV 111 on the upstream side of the refrigerant flow is closed after four-way valve 102 on the downstream side of the refrigerant flow is switched from state A to state B, and subsequently, compressor 10 is stopped.

Referring to FIGS. 2 and 7, with the operation stopped during heating, four-way valve 101 is set to state B, four-way valve 102 is set to state B, and both of LEVs 110 and 111 are closed. All of compressor 10, outdoor fan 41, and indoor fan 21 are set to the OFF (stopped) state. FIG. 7 differs from FIG. 6 in that four-way valve 101 is kept at state A when it is stopped after the cooling operation and is kept at state B when it is stopped after the heating operation.

If heating of FIG. 4 has been performed immediately before this state, refrigerant pressure is low in outdoor heat exchanger 40 and is high in indoor heat exchanger 20. When the state transitions from FIG. 4 to FIG. 7, LEV 111 is closed. The refrigerant pressure (high pressure) of indoor heat exchanger 20 is returned to refrigerant outlet 10*b* of compressor 10 by check valve 103. However, since refrigerant outlet 10*b* is separated from refrigerant inlet 10*a* and outdoor heat exchanger 40 (low pressure portion) by compressor 10 that has been stopped, the pressure of indoor heat exchanger 20 does not drop. While the operation is stopped, the refrigerant pressure of indoor heat exchanger 20 thus remains unchanged, allowing smooth start of heating.

Compressor 10 is premised on the configuration in which refrigerant inlet 10*a* and refrigerant outlet 10*b* do not communicate with each other while compressor 10 is stopped. Alternatively, similar effects can be achieved by providing a check valve at refrigerant inlet 10*a* or refrigerant cutlet 10*b* also in a configuration in which refrigerant inlet 10*a* and refrigerant outlet 10*b* communicate with each other while compressor 10 is stopped.

As described above, in the air conditioning system according to Embodiment 1, frost is formed on outdoor heat exchanger 40 during the heating operation, and LEV 111 is closed and the setting of four-way valves 101 and 102 is switched simultaneously with the cooling operation when the operation shifts to the defrosting operation (cooling operation). Then, high-temperature, high-pressure refrigerant is held in indoor heat exchanger 20 because high pressure is applied to the outlet side of check valve 103.

During the defrosting operation, LEV 110 of the bypass circuit is fully opened to perform the defrosting operation using only the refrigerant present in outdoor unit 2 during the heating operation. Since the refrigerant bypasses the circuit on the indoor unit 3 side to circulate into refrigerant inlet 10*a* of compressor 10, the defrosting operation is performed with a small amount of refrigerant. This reduces a time constant indicating a response speed of the refrigeration cycle, reducing the defrosting time. A reduction in defrosting time suppresses a decrease in room temperature during defrosting. This is effective especially for a system with a long extension pipe.

Since low-temperature, low-pressure refrigerant does not circulate through indoor heat exchanger 20 during defrosting unlike in a conventional case, indoor heat exchanger 20 does not serve as an evaporator during defrosting, eliminating the feeling of cold air on the indoor side. Although noise is easily felt due to indoor fan 21 stopped during defrosting, refrigerant does not circulate through indoor heat exchanger 20 in the present embodiment, thus reducing noise.

When heating is restarted after the completion of defrosting, high-temperature, high-pressure refrigerant has been retained on the indoor side, leading to faster startup of heating, which improves indoor comfort.

Although high-temperature refrigerant and low-temperature refrigerant are mixed while the operation is stopped in a conventional case, such an energy loss can be reduced in the present embodiment.

Although indoor fan 21 is stopped during defrosting with reference to FIG. 2, in the present embodiment, a breeze may be blown by indoor fan 21 to supply hot air into a room during defrosting because indoor heat exchanger 20 is filled with high-temperature refrigerant.

Embodiment 2

Figure 8:
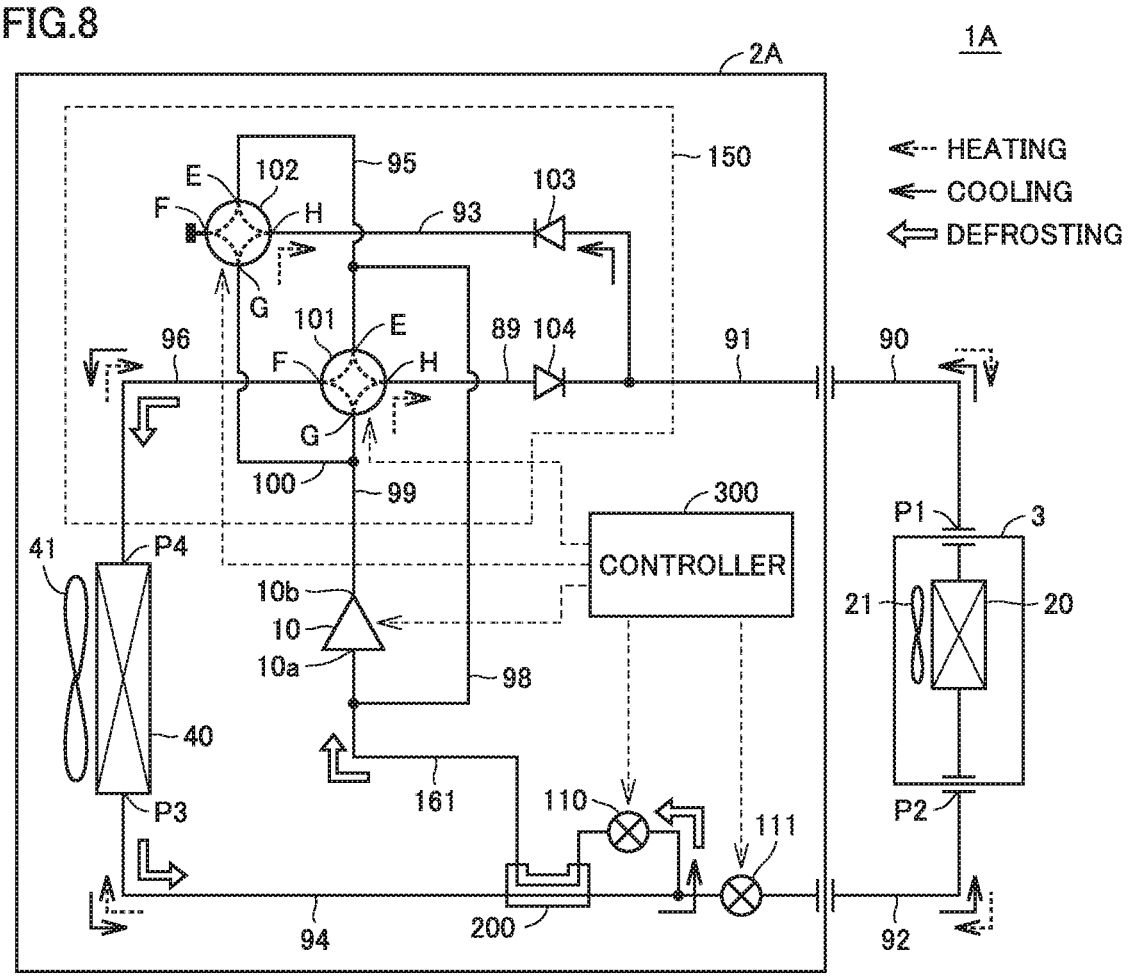
FIG. 8 shows a configuration of an air conditioning system 1A according to Embodiment 2.

FIG. 8 shows a configuration of an air conditioning system 1A according to Embodiment 2. FIG. 9 shows a relationship between an operation mode of an air conditioning system and a state in which a controller controls each component in Embodiment 2.

With reference to FIG. 8, air conditioning system 1A includes an outdoor unit 2A in place of outdoor unit 2 shown in FIG. 1. Outdoor unit 2A further includes a heat inter exchanger 200 in addition to the configuration of outdoor unit 2. Since the other configuration has been described with reference to FIG. 1, a description thereof will not be repeated here. Heat inter exchanger (HIC: Heat Inter exChanger) 200 is configured to perform heat exchange between the refrigerant flowing through pipe 94 and refrigerant flowing through bypass passage 161.

FIG. 9 differs from FIG. 2 in that LEV 110 performs SH control on the exit portion of heat inter exchanger 110 during cooling and during heating. This reduces a pressure loss at a low-pressure portion during cooling and during heating, improving the performance of the air conditioning system. Providing heat inter exchanger 200 increases the refrigerant density at the inlet of LEV 110, reducing a required bore of LEV 110. A low-cost, space-saving air conditioning system can thus be achieved. Since control of other portion of FIG. 9 is similar to that of FIG. 2, a description thereof will not be repeated here.

Embodiment 2 can achieve effects similar to those of Embodiment 1.

Embodiment 3

Figure 10:
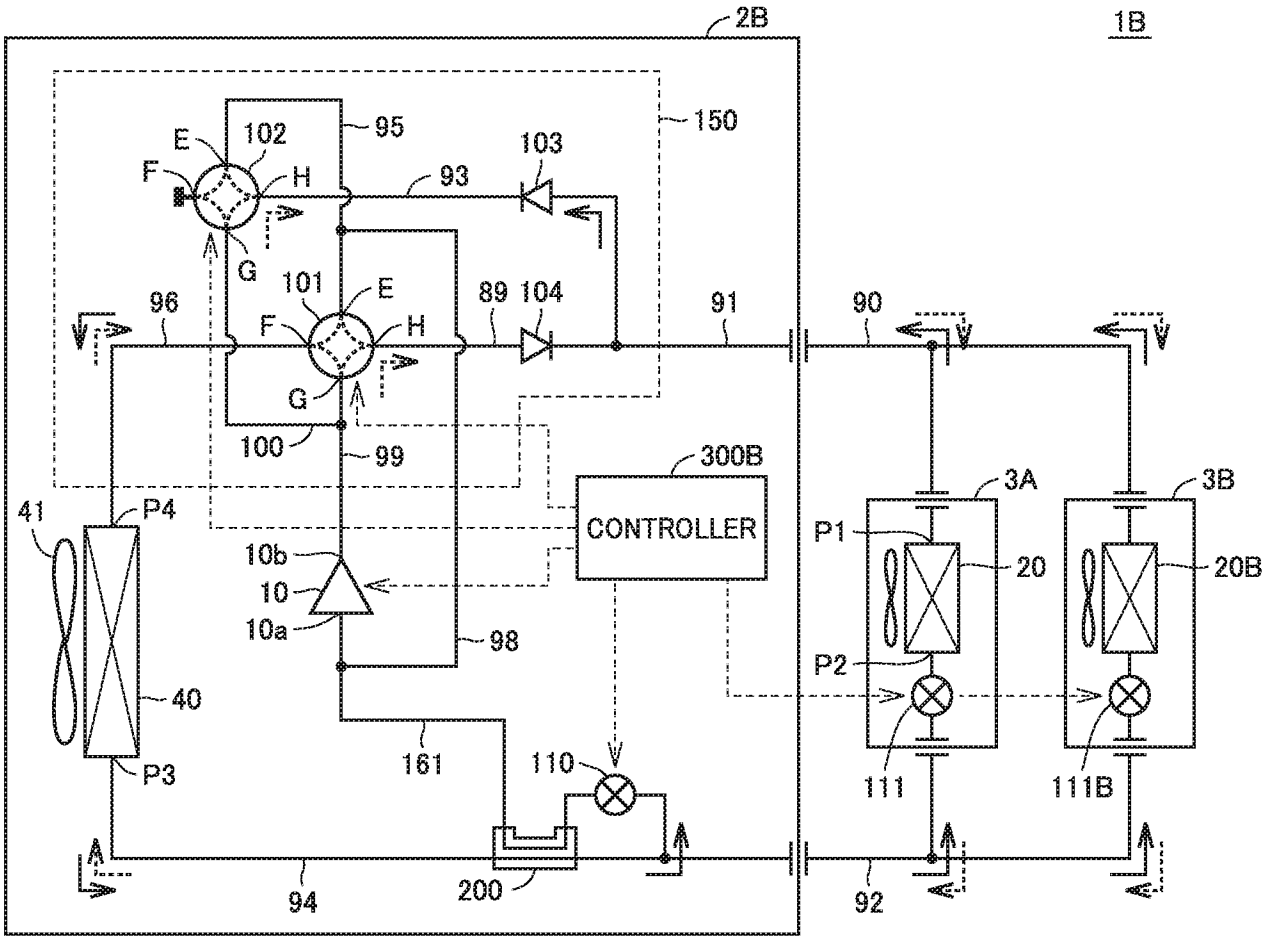
FIG. 10 shows a configuration of an air conditioning system 1B according to Embodiment 3.

FIG. 10 shows a configuration of an air conditioning system 1B according to Embodiment 3. FIG. 11 shows a relationship between an operation mode of an air conditioning system and a state in which a controller controls each component in Embodiment 3.

With reference to FIG. 10, air conditioning system 1B includes, in the configuration of air conditioning system 1A shown in FIG. 8, indoor units 3A and 3B connected in parallel with each other with respect to outdoor unit 2B in place of indoor unit 3. Indoor unit 3A includes indoor heat exchanger 20 and LEV 111. Indoor unit 3B includes an indoor heat exchanger 20B and an LEV 111B.

Outdoor unit 2B differs from outdoor unit 2A of FIG. 8 in that LEV 111 is located in indoor unit 3A but is similar to outdoor unit 2A in the other configuration. LEV 111 and LEV 111B are provided respectively in indoor units 3A and 3B in place of LEV 111 removed from outdoor unit 2B.

As shown in FIG. 11, control of LEV 111 and LEV 111B is identical to control of LEV 111 shown in FIG. 9.

Effects similar to those of Embodiments 1 and 2 can be achieved also in an air conditioning system having a multi-configuration in which a plurality of indoor units are connected to an outdoor unit.

Embodiment 4

Embodiments 1 to 3 provide a configuration in which refrigerant in the indoor unit and refrigerant in the extension pipe are separated from each other by LEV 111 and check valves 103 and 104 during defrosting, reducing a time constant by reducing a refrigerant amount, which reduces a defrosting time.

However, when an amount of refrigerant circulated between compressor 10 and outdoor heat exchanger 40 during the defrosting operation is small, the exit portion of the compressor is unlikely to have high pressure, so that the temperature of the refrigerant is unlikely to increase.

In Embodiment 4, thus, outdoor heat exchanger 40 is divided into two outdoor heat exchangers, and these two outdoor heat exchangers are alternately defrosted during the defrosting operation.

Figure 12:
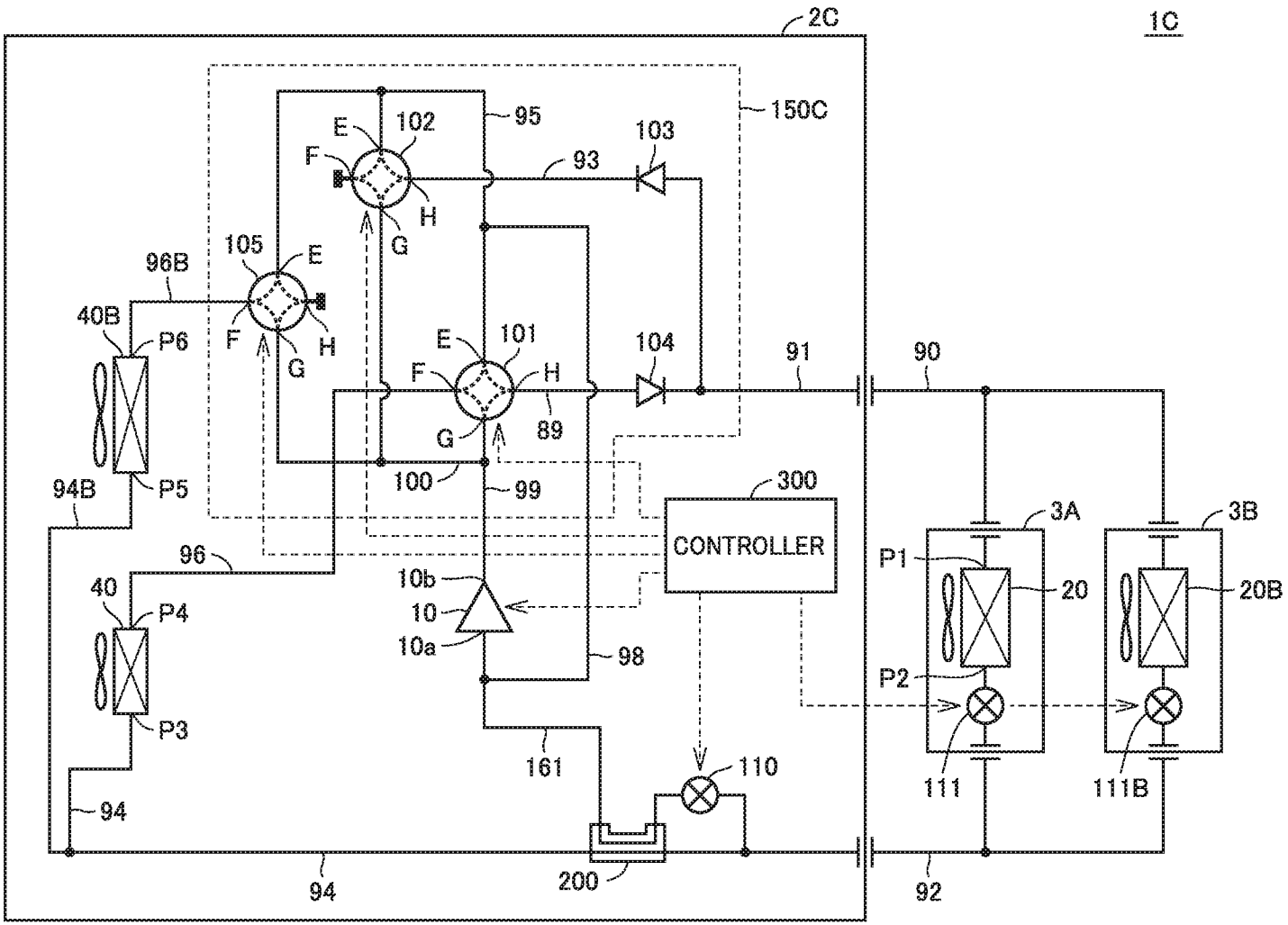
FIG. 12 shows a configuration of an air conditioning system 1C according to Embodiment 4.

FIG. 12 shows a configuration of an air conditioning system 1C according to Embodiment 4. FIG. 13 shows a relationship between an operation mode of an air conditioning system and a state in which a controller controls each component in Embodiment 4.

Air conditioning system 1C includes an outdoor unit 2C in the configuration of air conditioning system 1B shown in FIG. 10 in place of outdoor unit 2B. Outdoor unit 2C further includes an outdoor heat exchanger 40B and a four-way valve 105 in addition to outdoor heat exchanger 40 of outdoor unit 2B. Four-way valve 105, port H of which is closed externally, functions as a three-way valve. Outdoor heat exchanger 40 and outdoor heat exchanger 40B may be obtained by, for example, dividing one outdoor heat exchanger into upper and lower portions.

Pipe 95 connects port E four-way valve 101, port E of four-way valve 102, and port E of four-way valve 105 to one another. Pipe 100 connects port G of four-way valve 101, port G of four-way valve 102, and port G of four-way valve 105 to one another.

Pipe 96 connects port F of four-way valve 101 and port P4 of outdoor heat exchanger 40 to each other. Pipe 96B connects port F of four-way valve 105 and port P6 of outdoor heat exchanger 40B to each other. Port P3 of outdoor heat exchanger 40 is connected to the end of pipe 94.

A pipe 94B branches off from pipe 94 and has an end connected to port P5 of outdoor heat exchanger 40B.

Since connection of a refrigerant passage of the other portion is similar to that of air conditioning system 19 shown in FIG. 10, a description thereof will not be repeated here.

FIG. 13 differs from FIG. 9 in that control of four-way valve 105 is added.

In the present embodiment, four-way valves 101, 102, and 105 and check valves 103 and 104 constitute a cooling-heating switching mechanism 150C that switches a flow direction of refrigerant between during cooling and during heating.

Four-way valve 105 is controlled to enter state A during the cooling mode, during the second defrosting mode, and during the operation stopped, and is controlled to enter state B during the heating mode and during the first defrosting mode. Control of the other portion of FIG. 13 is similar to that of FIG. 9.

Hereinafter, the operations of the air conditioning system will be described while showing the flow direction of refrigerant in each operation mode as in Embodiment 1.

Figure 14:
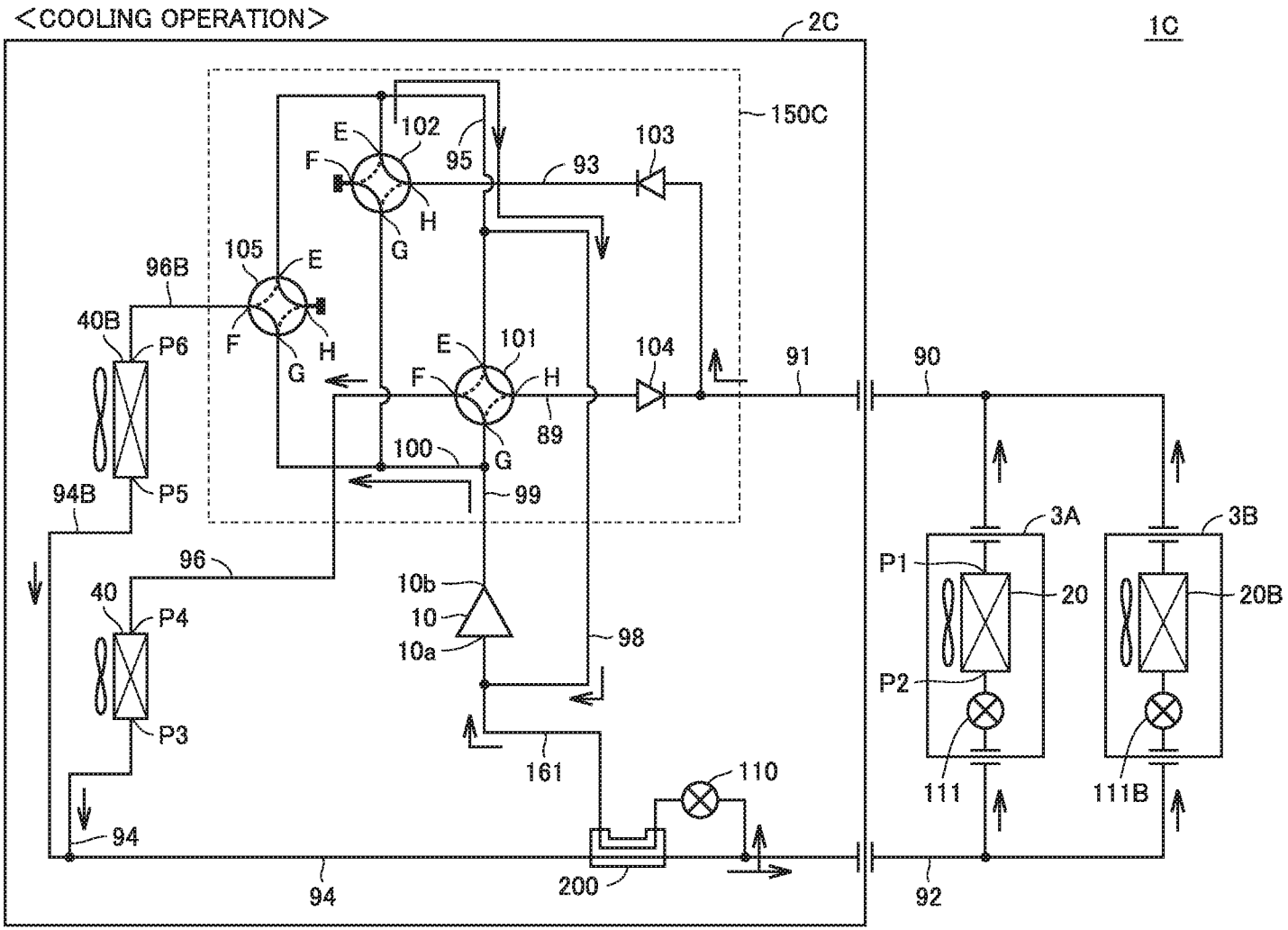
FIG. 14 shows a flow of refrigerant during a cooling operation in Embodiment 4.

FIG. 14 shows a flow of refrigerant during the cooling operation in Embodiment 4. With reference to FIGS. 13 and 14, compressor 10 suctions refrigerant form pipe 91 through check valve 103, pipe 93, four-way valve 102, pipe 95, and pipe 98, and then compresses the refrigerant. The compressed refrigerant flows through four-way valve 101 to pipe 96 and also flows through pipe 100 and four-way valve 105 to pipe 96B.

Outdoor heat exchanger 40 (condenser) condenses the refrigerant, which has flowed from compressor 10 through four-way valve 101 into pipe 96, and flows the condensed refrigerant to pipe 94. Outdoor heat exchanger 40B (condenser) condenses the refrigerant, which has flowed from compressor 10 through four-way valve 105 into pipe 96B, and flows the condensed refrigerant to pipe 94B.

Outdoor heat exchangers 40 and 40B (condenser) are configured to perform heat exchange (heat dissipation) of high-temperature, high-pressure superheated steam (refrigerant) discharged from compressor 10 with outdoor air. The refrigerant condenses into liquid through this heat exchange. Outdoor fans (not shown) are provided side by side with outdoor heat exchangers 40 and 40B (condenser), and controller 300 adjusts the rotation speed of the outdoor fan in response to a control signal. Changing the rotation speed of the outdoor fan can adjust a heat exchange amount per unit time between the refrigerant in outdoor heat exchangers 40 and 40B (condenser) and outdoor air.

LEVs 111 and 111B decompress the refrigerant that has flowed from outdoor heat exchangers 40 and 40B (condenser) to pipe 94. The decompressed refrigerant flows to indoor heat exchangers 20 and 20B. LEVs 111 and 111B are configured to adjust a degree of opening in response to control signals received from controller 300.

Indoor heat exchangers 20 and 20B (evaporator) evaporate the refrigerant that has flowed from LEVs 111 and 111B to pipe 92. The evaporated refrigerant flows through pipes 90 and 91, check valve 103, pipe 93, four-way valve 102, and pipes 95 and 98 to refrigerant inlet 10*a* of compressor 10. Indoor heat exchangers 20 and 20B (evaporator) are configured to perform heat exchange (heat absorption) of the refrigerant decompressed by LEVs 111 and 111B with indoor air. The refrigerant evaporates into superheated steam through this heat exchange. Indoor fans (not shown) are provided side by side with indoor heat exchangers 20 and 20B (evaporator). Controller 300 adjusts the rotation speed of the indoor fans by control signals. Changing the rotation speed of the indoor fans can adjust a heat exchange amount per unit time between the refrigerant in indoor heat exchangers 20 and 20B (evaporator) and indoor air.

The heating mode will now be described. Referring again to FIG. 13, in the heating mode, all of four-way valves 101, 102, and 105 are set to state B, LEV 110 is subjected to SH control at the exit portion of heat inter exchanger 200, and LEVs 111 and 111B are subjected to SH control or SC control. Further, the operation frequency of compressor 10 is set in accordance with a set temperature, and both of the outdoor fans and the indoor fans are set to the ON (rotation) state.

Figure 15:
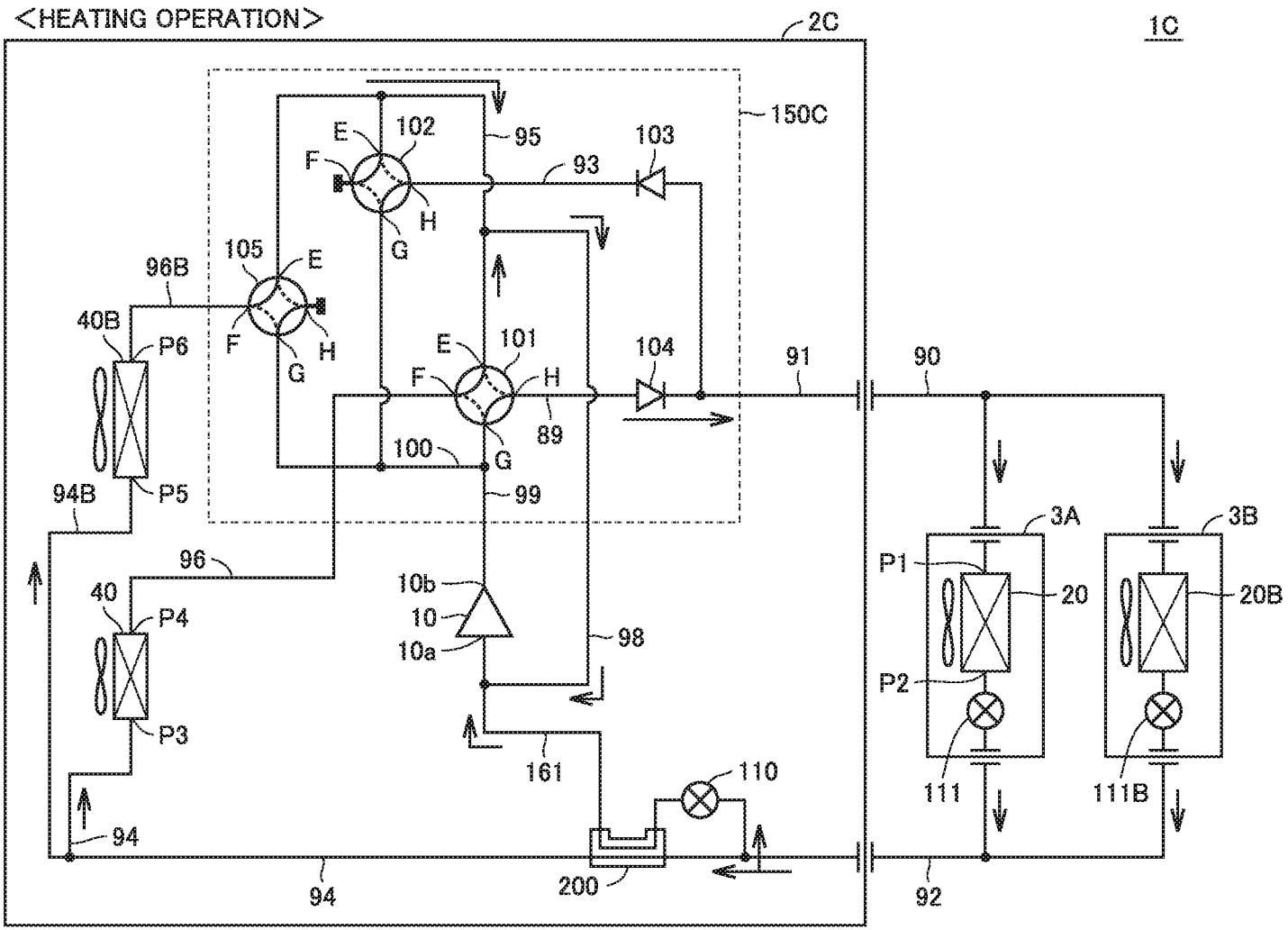
FIG. 15 shows a flow of refrigerant during a heating operation in Embodiment 4.

FIG. 15 shows a refrigerant flow during the heating operation in Embodiment 4. With reference to FIG. 15, compressor 10 suctions refrigerant from pipe 96 through tour-way valve 101, pipe 95, and pipe 98, suctions refrigerant from pipe 96B through four-way valve 105, pipe 95, and pipe 98, and compresses the suctioned refrigerant. The compressed refrigerant flows through four-way valve 101, pipe 89, check valve 104, and pipe 91 to pipe 90.

Indoor heat exchangers 20 and 20B (condenser) condense the refrigerant that has flowed from compressor 10 through four-way valve 101 and check valve 104 into pipe 90. Indoor heat exchangers 20 and 209 (condenser) are configured to perform heat exchange (heat dissipation) of high-temperature, high-pressure superheated steam (refrigerant) discharged from compressor 10 with indoor air. The refrigerant condenses into liquid through this heat exchange. Controller 300 adjusts the rotation speed of indoor fans (not shown) by control signals. Changing the rotation speed of the indoor fans can adjust a heat exchange amount per unit time between the refrigerant in indoor heat exchangers 20 and 20B (condenser) and indoor air.

LEV 111 decompresses the refrigerant that hat passed through indoor heat exchanger 20 (condenser). LEV 111B decompresses the refrigerant that has passed through indoor heat exchanger 20B (condenser). The decompressed refrigerant flows through pipe 92 to pipe 94.

Outdoor heat exchanger 40 (evaporator) evaporates the refrigerant that has flowed from pipe 94. Outdoor heat exchanger 40B (evaporator) evaporates the refrigerant that has flowed from pipe 94B branched off from pipe 94.

The refrigerant evaporated in outdoor heat exchanger 40 (evaporator) flows through pipe 96, four-way valve 101, and pipe 98 to refrigerant inlet 10*a* of compressor 10. The refrigerant evaporated in outdoor heat exchanger 40B (evaporator) flows through pipe 969, four-way valve 105, and pipes 95 and 98 to refrigerant inlet 10*a* of compressor 10.

Outdoor heat exchangers 40 and 40B (evaporator) are configured to perform heat exchange (heat absorption) of the refrigerant decompressed by LEVs 111 and 111B with outdoor air. The refrigerant evaporates into superheated steam through this heat exchange. Controller 300 adjusts the rotation speed of outdoor fans (not shown) by control signals. Changing the rotation speed of the outdoor fan can adjust a heat exchange amount per unit time between the refrigerant in outdoor heat exchanger 40 (evaporator) and indoor air.

During the heating operation as described above, frost may be formed on outdoor heat exchangers 40 and 40B and may need to be removed. In Embodiments 1 to 3, bypass passage 161 and LEV 110 are provided, and the defrosting operation is performed with indoor heat exchanger 20 separated from outdoor heat exchanger 40 and compressor 10 by LEV 111, four-way valve 102, and check valves 103 and 104.

During the heating operation, however, outdoor heat exchanger 40 is on the low pressure side, leading to a decreasing amount of refrigerant present on the low pressure side. In this case, refrigerant required for defrosting lacks if surplus refrigerant is little in outdoor heat exchanger 40 and compressor 10, so that high pressure may be difficult to obtain. Since gas refrigerant is compressed by compressor 10 to have high temperature and high pressure, a high temperature required for defrosting also cannot be obtained if high pressure is not obtained.

In Embodiment 4, thus, outdoor heat exchangers 40 and 40B are alternately defrosted, thus reducing a refrigerant amount required for defrosting.

Figure 16:
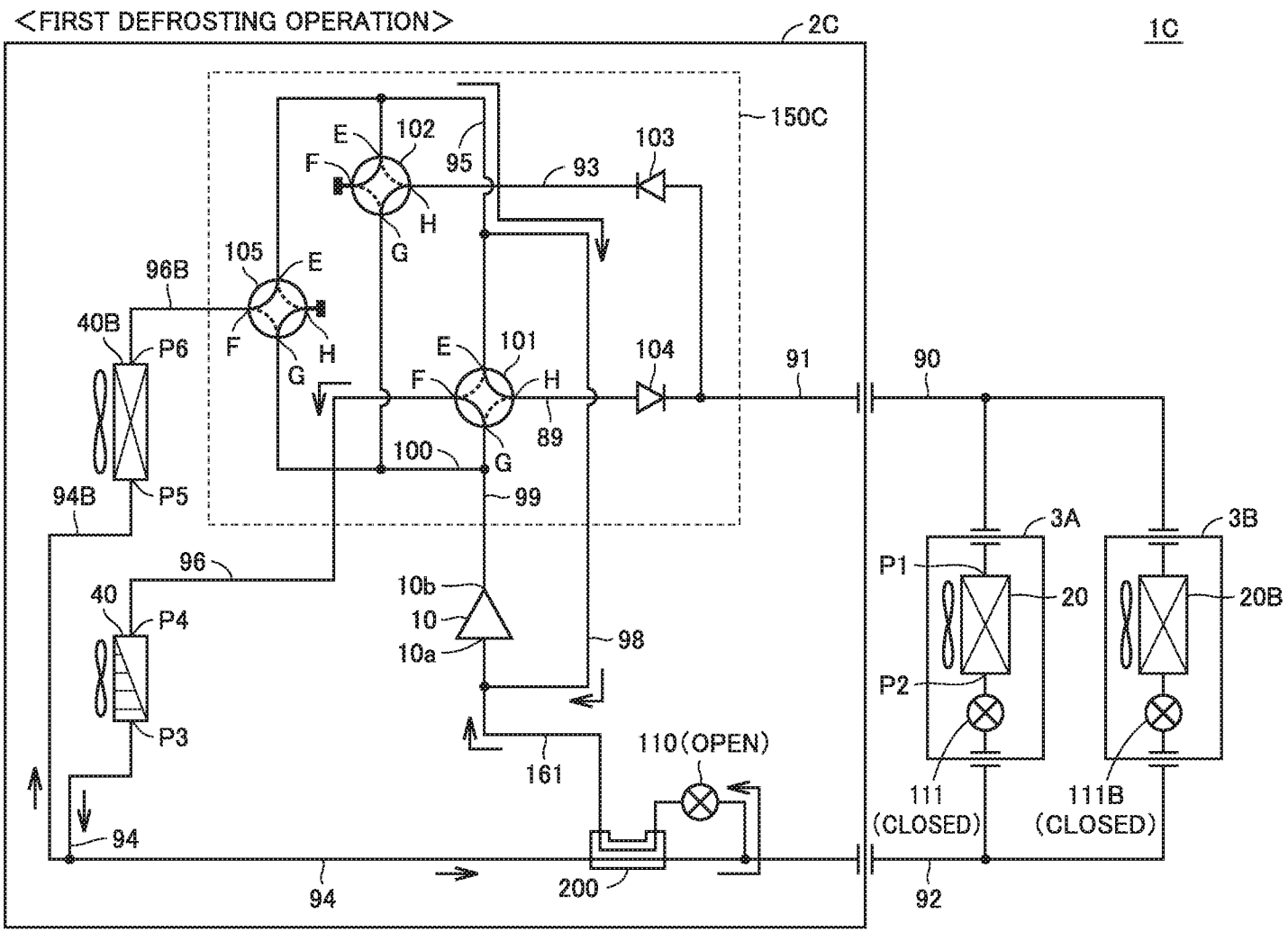
FIG. 16 shows a flow of refrigerant during a first defrosting operation of defrosting an outdoor heat exchanger 40.
Figure 17:
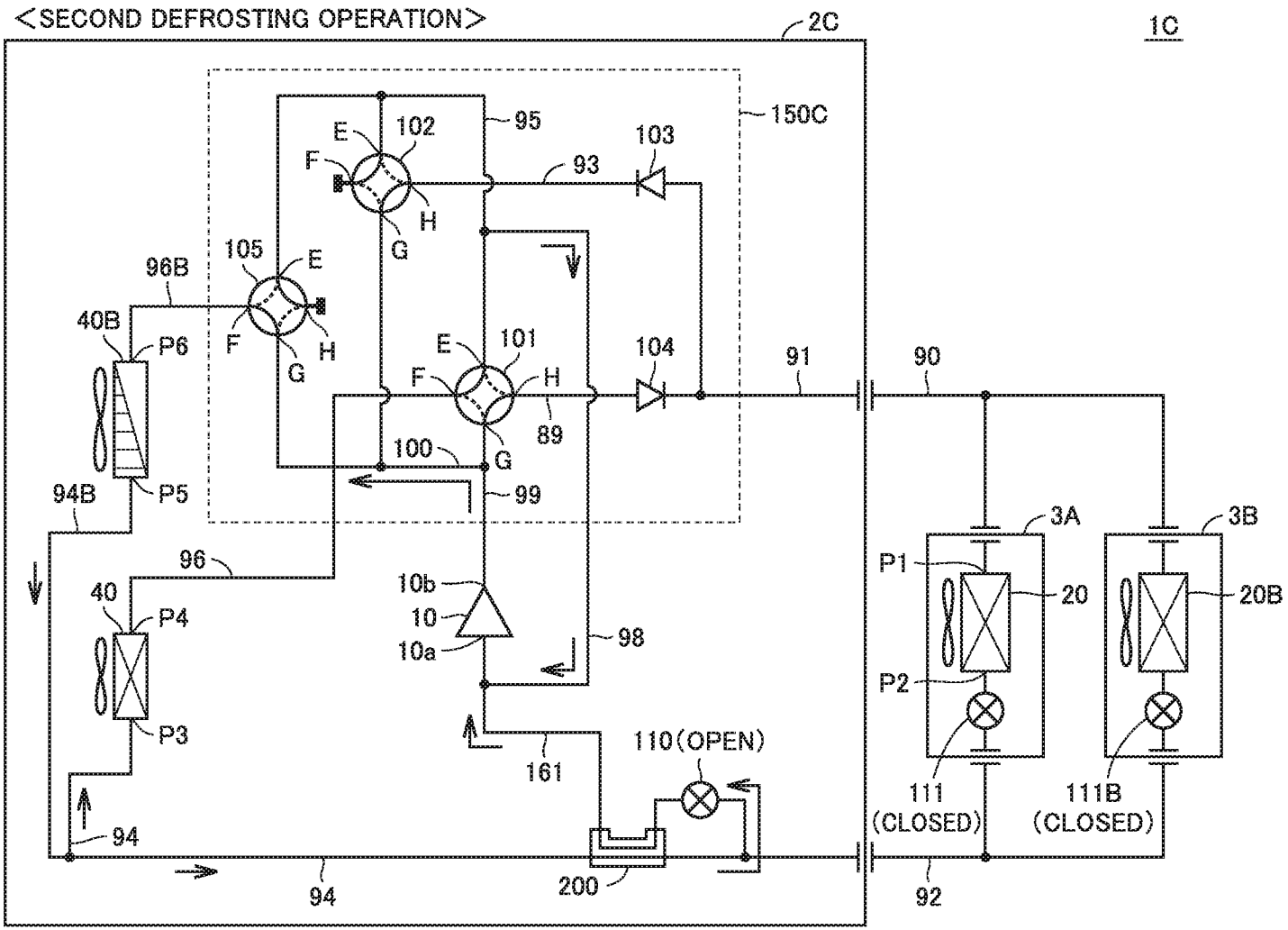
FIG. 17 shows a flow of refrigerant during a second defrosting operation of defrosting an outdoor heat exchanger 40B.

A refrigerant flow during the defrosting operation will now be described with reference to the drawings. FIG. 16 shows a refrigerant flow during a first defrosting operation of defrosting outdoor heat exchanger 40. FIG. 17 shows a refrigerant flow during a second defrosting operation of defrosting outdoor heat exchanger 40B.

Referring to FIGS. 13 and 16, during the first defrosting operation, four-way valve 101 is set to state A, four-way valve 102 is set to state B, four-way valve 105 is set to state B, LEV 110 is set to be fully open, and LEV 111 and LEV 111B are closed. Further, the operation frequency of compressor 10 is set to a predetermined fixed frequency, and both of the outdoor fan and the indoor fan are set to the OFF (stopped) state.

Compressor 10 suctions refrigerant from bypass passage 161 and pipe 98 and compresses the refrigerant. The refrigerant that has been compressed to have high temperature and high pressure flows through four-way valve 101 to pipe 96.

Outdoor heat exchanger 40 (condenser) with frost formed thereon cools and condenses the refrigerant, and then flows the refrigerant to pipe 94. A part of the refrigerant flows through outdoor heat exchanger 40B (operating as an evaporator), four-way valve 105, and pipes 95 and 98 back to refrigerant inlet 10*a* of compressor 10. The rest of the refrigerant flows through LEV 110, heat inter exchanger 200, and bypass passage 161 back to refrigerant inlet 10*a* of compressor 10.

In the configuration in which an outdoor heat exchanger is divided as described above, outdoor heat exchanger 40 that is one of the two outdoor heat exchangers is first defrosted, thus reducing a refrigerant amount required for defrosting.

After the completion of defrosting of outdoor heat exchanger 40, the process shifts to the second defrosting operation to defrost outdoor heat exchanger 40B.

With reference to FIGS. 13 and 17, four-way valve 101 is set to state B and four-way valve 105 is set to state A in the second defrosting operation. The other setting is similar to that of the first defrosting operation.

Compressor 10 suctions refrigerant from bypass passage 161 and pipe 98 and compresses the refrigerant. The refrigerant that has been compressed to have high temperature and high pressure does not pass through four-way valve 101 but flows through pipe 100 and four-way valve 105 to outdoor heat exchanger 40B (condenser). The refrigerant does not pass through check valve 104 that is located ahead of four-way valve 101 from the following reason. Both of LEVs 111 and 111B are closed in indoor heat exchangers 20 and 20B located ahead of check valve 104, and accordingly, the pressure on the outlet side of check valve 104 rises to prevent the refrigerant from passing through check valve 104 further.

Outdoor heat exchanger 40B (condenser) with frost formed thereon cools and condenses the refrigerant and flows the refrigerant to pipe 94B. A part of the refrigerant flows through outdoor heat exchanger 40 (operating as an evaporator), four-way valve 101, and pipes 95 and 98 back to refrigerant inlet 10*a* of compressor 10. The rest of the refrigerant flows through LEV 110, heat inter exchanger 200, and bypass passage 161 back to refrigerant inlet 10*a* of compressor 10.

As in Embodiments 1 to 3, the air conditioning system shown in Embodiment 4 also achieves an effect of fast startup also in starting heating or starting cooling after the operation has been stopped. The state in which an operation is stopped will now be described.

Figure 18:
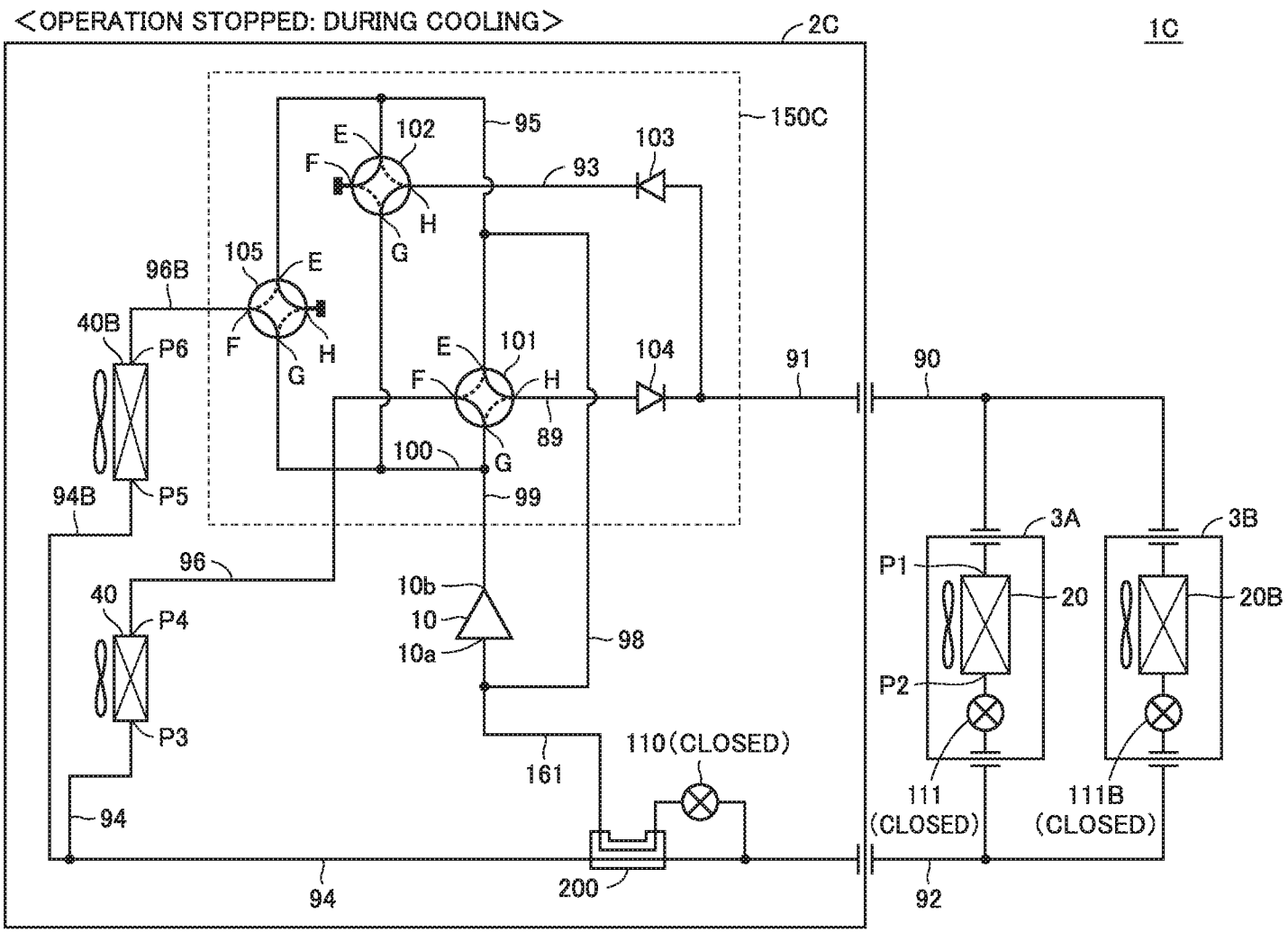
FIG. 18 shows a state in which an operation is stopped during cooling in Embodiment 4.
Figure 19:
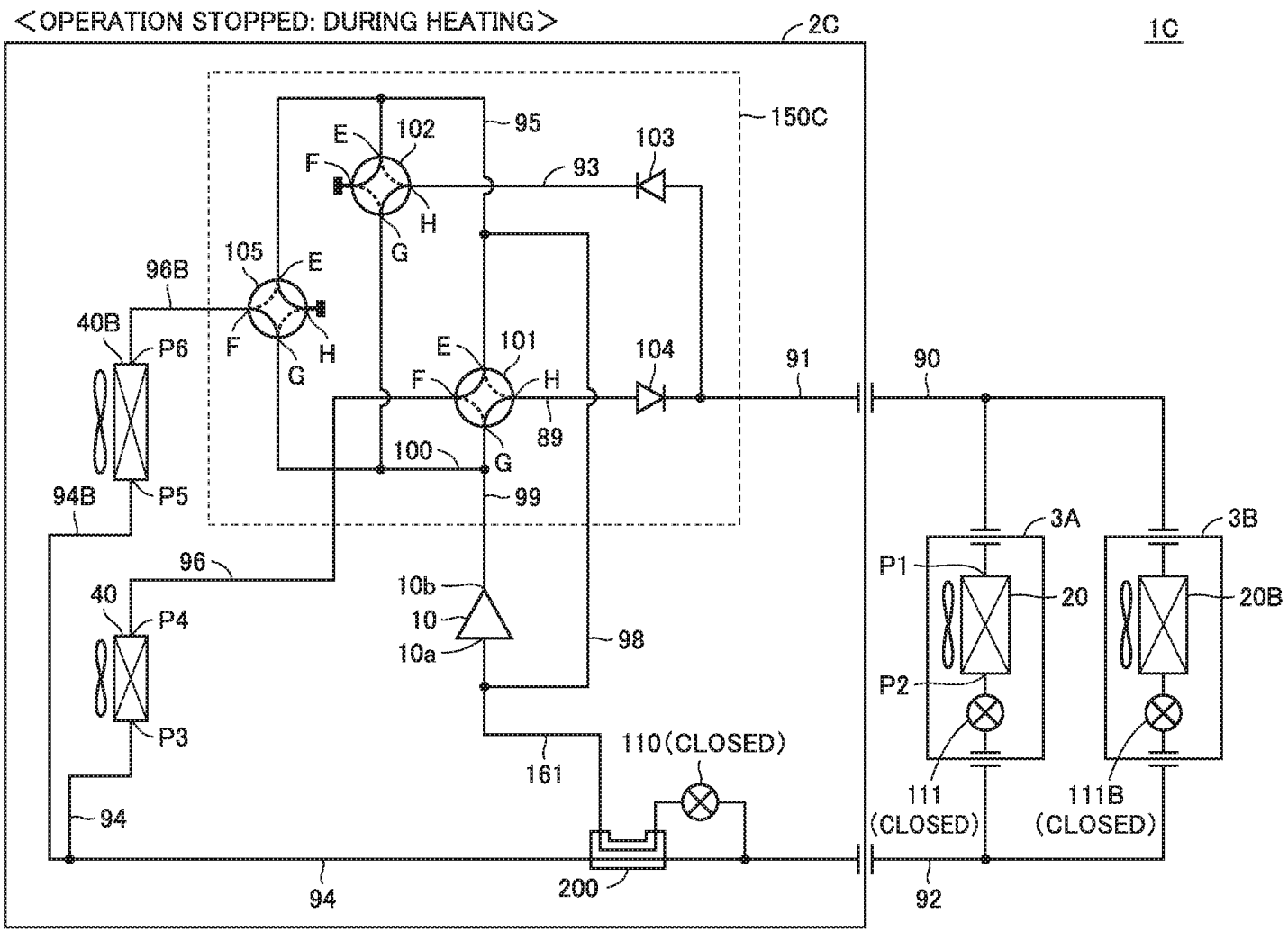
FIG. 19 shows a state in which an operation is stopped during heating in Embodiment 4.

FIG. 18 shows a state in which an operation is stopped during cooling in Embodiment 4. FIG. 19 shows a state in which an operation is stopped during heating in Embodiment 4.

Referring to FIGS. 13 and 18, with the operation stopped during cooling, four-way valve 101 is set to state A, four-way valve 102 is set to state B, four-way valve 105 is set to state A, and all of LEVs 110, 111, and 111B are closed. All of compressor 10, the outdoor fans, and the indoor fans are set to the OFF (stopped) state.

If cooling of FIG. 14 has been performed immediately before this state, refrigerant pressure is high in outdoor heat exchangers 40 and 40B and is low in indoor heat exchangers 20 and 20B. After the state shifts from FIG. 14 to FIG. 18, switching of four-way valve 102 applies a reverse pressure to check valve 103, and LEVs 111 and 111B are closed. For check valve 104, since LEV 110 is closed and is separated from the high-pressure portion of outdoor heat exchanger 40 by compressor 10, an outflow of refrigerant stops when the pressure of bypass passage 161 drops to be equal to the pressure of indoor heat exchangers 20 and 20B. While an operation is stopped, the refrigerant pressure of outdoor heat exchangers 40 and 40B thus remains unchanged, allowing fast start of cooling.

Referring to FIGS. 13 and 19, with the operation stopped during heating, four-way valve 101 is set to state B, four-way valve 102 is set to state B, four-way valve 105 is set to state A, and all of LEVs 110, 111, and 111B are closed. All of compressor 10, the outdoor fan, and the indoor fan are set to the OFF (stopped) state. FIG. 19 differs from FIG. 18 in that four-way valve 101 is kept in state A during stop after the cooling operation and is kept in state B during stop after the heating operation.

If heating in FIG. 15 has been performed immediately before this state, refrigerant pressure is low in outdoor heat exchangers 40 and 40B and is high in indoor heat exchangers 20 and 208. When the state shifts from FIG. 15 to FIG. 19, LEVs 111 and 111B are closed. Although the refrigerant pressure (high pressure) of indoor heat exchangers 20 and 20B is returned to refrigerant outlet 10*b* of compressor 10 by check valve 103, heat exchangers 20 and 20B are separated from outdoor heat exchangers 40 and 40B, which is a low-pressure portion, by compressor 10, and a pressure drop thus does not occur. The refrigerant pressure of indoor heat exchangers 20 and 20B remains unchanged while the operation is stopped, allowing fast start of heating.

As described above, air conditioning system 1C of Embodiment 4 can achieve effects similar to those of Embodiments 1 to 3, and can also reduce a refrigerant amount required for defrosting by dividing an outdoor heat exchanger and alternately defrosting divided two outdoor heat exchangers.

Although air conditioning system 1C of Embodiment 4 shown in FIG. 12 includes heat inter exchanger 200 and two indoor units, it may include one indoor unit or three or more indoor units, or may include no heat inter exchanger 200.

Lastly, Embodiments 1 to 4 will be summarized with reference to the drawings again.

With reference to FIG. 1, air conditioning system 1 according to Embodiment 1 includes compressor 10, indoor heat exchanger 20, outdoor heat exchanger 40, LEV 111, bypass passage 161, LEV 110, and cooling-heating switching mechanism 150. Compressor 10 has refrigerant inlet 10*a* for suctioning refrigerant and refrigerant outlet 10*b* for discharging the refrigerant. Indoor heat exchanger 20 has first port P1 and second port P2. Outdoor heat exchanger 40 has third port P3 and fourth port P4. LEV 111 is configured to communicate between second port P2 and third port P3. LEV 111 is provided in a refrigerant passage between second port P2 and third port P3, and is configured to open and close the refrigerant passage. Bypass passage 161 is configured to be at least a part, of a flow passage connecting third port P3 to refrigerant inlet 10*a*. LEV 110 is provided in bypass passage 161 and configured to open and close bypass passage 161. Cooling-heating switching mechanism 150 is connected to refrigerant inlet 10*a*, refrigerant outlet 10*b*, first port P1, and fourth port P4.

Cooling-heating switching mechanism 150 includes first check valve 103, second check valve 104, four-way valve 102, and four-way valve 101. First check valve 103 has a first inlet and a first outlet, and the first inlet communicates with first port P1. Second check valve 104 has a second inlet and a second outlet, and the second outlet communicates with first port P1. Four-way valve 102 is configured to cause the first outlet of first check valve 103 to communicate with one of refrigerant inlet 10*a* and refrigerant outlet 10*b* of compressor 10. Four-way valve 101 is configured to cause the second inlet of the second check valve to communicate with one of refrigerant inlet 10*a* and refrigerant outlet 10*b* of compressor 10 and cause fourth port P4 to communicate with the other of refrigerant inlet 10*a* and refrigerant outlet 10*b* of compressor 10.

The above configuration enables the defrosting operation with indoor heat exchanger 20 separated from the refrigeration cycle, in addition to usual cooling and heating operations.

In particular, a check valve is incorporated in cooling-heating switching mechanism 150 in the present embodiment, and thus, effects (1) to (3) below are expected.

(1) If a solenoid valve is used in place of a check valve, in a large-diameter portion of a pipe through which gas refrigerant is caused to pass, a valve having a large structure such as a motor-operated valve (with a built-in motor) needs to be used, requiring a housing space in the outdoor unit. Any check valve that is relatively simple and has a small structure can be used also in a large-pipe-diameter portion, leading to reduced space.

(2) Although a solenoid valve needs a wire for sending a control signal, a check valve requires no wire, leading to a reduced number of wires.

(3) When the indoor unit is filled with refrigerant by LEV and a solenoid valve, the refrigerant may leak a little if the solenoid valve is not closed simultaneously with closing the LEV. A combination of the LEV and check valve does not need to coordinate the timing at which the valves are closed, allowing filling of the refrigerant without leaking.

Air conditioning system 1 preferably further includes controller 300 that controls compressor 10, LEV 111, LEV 110, four-way valve 102, and four-way valve 101. As shown in FIG. 5, when the defrosting operation of outdoor heat exchanger 40 is performed, controller 300 causes LEV 111 to close the refrigerant passage, opens LEV 110, controls four-way valve 101 to cause the refrigerant inlet of second check valve 104 to communicate with refrigerant inlet 10*a* of compressor 10 and cause fourth port P4 to communicate with refrigerant outlet 10*b*, controls four-way valve 102 to cause the refrigerant outlet of first check valve 103 to communicate with refrigerant outlet 10*b* of compressor 10, and operates compressor 10.

Through such control, the defrosting operation is performed using only the refrigerant present in outdoor unit 2 during the heating operation. Since the refrigerant bypasses the circuit on the indoor unit 3 side and circulates to refrigerant inlet 10*a* of compressor 10, the defrosting operation is performed with a small refrigerant amount. This reduces a time constant indicating a response speed of the refrigeration cycle, thus reducing a defrosting time. Reducing a defrosting time suppresses a decrease in room temperature during defrosting.

More preferably, when an operation is stopped during the cooling operation as shown in FIG. 6, controller 300 causes LEV 111 to close the refrigerant passage, closes LEV 110, controls four-way valve 101 to cause the refrigerant inlet of second check valve 104 to communicate with refrigerant inlet 10*a* of compressor 10 and cause fourth port P4 to communicate with refrigerant outlet 101, controls four-way valve 102 to cause the refrigerant outlet of first check valve 103 to communicate with refrigerant outlet 10*b* of compressor 10, and stops the operation of compressor 10.

The control described above can stop an operation while maintaining the pressure distribution of refrigerant in which the outdoor heat exchanger (condenser) is located on the high-pressure side and the indoor heat exchanger (evaporator) is located on the low-pressure side as a result of the cooling operation. Thus, compared with a conventional case in which an operation is stopped and pressure is accordingly made uniform, an operation startup time can be reduced and power consumption can be reduced when cooling is restarted.

When an operation is stopped during the heating operation as shown in FIG. 7, controller 300 more preferably causes LEV 111 to close the refrigerant passage, closes LEV 110, controls four-way valve 101 to cause the refrigerant inlet of second check valve 104 to communicate with refrigerant outlet 10*b* of compressor 10 and cause fourth port P4 to communicate with refrigerant inlet 10*a*, controls four-way valve 102 to cause the refrigerant outlet of first check valve 103 to communicate with refrigerant outlet 10*b* of compressor 10, and stops the operation of compressor 10.

The control described above can stop an operation while maintaining the pressure distribution of refrigerant in which the indoor heat exchanger (condenser) located on the high-pressure side and the outdoor heat exchanger (evaporator) is located on the low-pressure side as a result of the heating operation. Compared with a conventional case in which an operation is stopped and pressure is accordingly made uniform, an operation startup time can be reduced and power consumption can be reduced when heating is restarted.

As shown in FIG. 8, air conditioning system 1A of Embodiment 2 preferably further includes heat inter exchanger 200 configured to perform heat exchange between the refrigerant flowing through bypass passage 161 and the refrigerant flowing through the flow passage between third port P3 and LEV 111, in addition to the configuration of air conditioning system 1 of Embodiment 1.

In such a configuration, the use of heat inter exchanger 200 reduces a pressure loss in a low-pressure portion during cooling and during heating, thus improving the performance of the air conditioner. Since the refrigerant density at the refrigerant inlet of LEV 110 increases, a required bore of LEV 110 decreases, achieving a low-cost, space-saving air conditioner.

As shown in FIG. 10 (or FIG. 12), compressor 10, outdoor heat exchanger 40, bypass passage 161, LEV 110, and cooling-heating switching mechanism 150 (150C) are preferably housed in outdoor unit 2B (2C). Indoor heat exchanger 20 and LEV 111 are housed in first indoor unit 3A. Air conditioning system 1B (or 1C) further includes second indoor unit 3B that is connected in parallel with first indoor unit 3A and has indoor heat exchanger 20B and LEV 111B.

Also such a configuration including a plurality of indoor units can perform, in addition to normal cooling and heating operations, the defrosting operation with indoor heat exchanger 20 separated from the refrigeration cycle.

As shown in FIG. 12, air conditioning system 1C preferably further includes outdoor heat exchanger 40B having fifth port P5 and sixth port P6. Fifth port P5 communicates with third port P3. Cooling-heating switching mechanism 150C further includes in addition to the configuration of cooling-heating switching mechanism 150, four-way valve 105 configured to cause sixth port P6 to communicate with one of refrigerant inlet 10*a* and refrigerant outlet 10*b* of compressor 10.

Such a configuration in which the outdoor heat exchanger is divided into two outdoor heat exchangers enables defrosting while limiting the range of the outdoor heat exchanger. This reduces a refrigerant amount required for defrosting.

The air conditioning system more preferably further includes controller 300 that controls compressor 10, LEV 111, LEV 110, four-way valve 102, four-way valve 105, and four-way valve 101. When the defrosting operation of outdoor heat exchanger 40 is performed, controller 300 causes LEV 111 to close the refrigerant passage, opens LEV 110, controls four-way valve 101 to cause the refrigerant inlet of second check valve 104 to communicate with refrigerant inlet 10*a* of compressor 10 and cause fourth port P4 to communicate with refrigerant outlet 10*b* of compressor 10, controls four-way valve 102 to cause the refrigerant outlet of first check valve 103 to communicate with refrigerant outlet 10*b* of compressor 10, controls four-way valve 105 to cause sixth port P6 to communicate with refrigerant inlet 10*a* of compressor 10, and operates compressor 10.

When the defrosting operation of outdoor heat exchanger 40B is performed, controller 300 more preferably causes LEV 111 to close the refrigerant passage, opens LEV 110, controls four-way valve 101 to cause the refrigerant inlet of second check valve 104 to communicate with refrigerant outlet 10*b* of compressor 10 and cause fourth port P4 to communicate with refrigerant inlet 10*a*, controls four-way valve 102 to cause the refrigerant outlet of first check valve 103 to communicate with refrigerant outlet 10*b* of compressor 10, controls four-way valve 105 to cause sixth port P6 to communicate with refrigerant outlet 10*b* of compressor 10, and operates compressor 10.

The control described above enables defrosting while selecting one of outdoor heat exchanger 40 and outdoor heat exchanger 40B. This also enables alternate defrosting.

As shown in FIG. 18, when the operation is stopped during the cooling operation, controller 300 more preferably causes LEVs 111 and 111B to close the refrigerant passage, closes LEV 110, controls four-way valve 101 to cause the refrigerant inlet of second check valve 104 to communicate with refrigerant inlet 10*a* of compressor 10 and cause fourth port P4 to communicate with refrigerant outlet 10*b*, controls four-way valve 102 to cause the refrigerant outlet of first check valve 103 to communicate with refrigerant outlet 10*b* of compressor 10, controls four-way valve 105 to cause sixth port P6 to communicate with refrigerant outlet 10*b* of compressor 10, and stops the operation of compressor 10.

The control described above can stop an operation stopped while maintaining the pressure distribution of refrigerant in which the outdoor heat exchanger (condenser) is located on the high-pressure side and the indoor heat exchanger (evaporator) is located on the low-pressure side as a result of the cooling operation even in the configuration in which the outdoor heat exchanger is divided. Thus, compared with a conventional case in which an operation is stopped and pressure is accordingly made uniform, an operation startup time can be reduced and power consumption can be reduced when cooling is restarted.

As shown in FIG. 19, when the operation is stopped during the heating operation, controller 300 more preferably causes LEVs 111 and 111B to close the refrigerant passage, closes LEV 110, controls four-way valve 101 to cause the refrigerant inlet of second check valve 104 to communicate with refrigerant outlet 10*b* of compressor 10 and cause fourth port P4 to communicate with refrigerant inlet 10*a*, controls four-way valve 102 to cause the refrigerant outlet of first check valve 103 to communicate with refrigerant outlet 10*b* of compressor 10, controls four-way valve 105 to cause sixth port P6 to communicate with refrigerant outlet 10*b* of compressor 10, and stops the operation of compressor 10.

The above control can stop an operation while maintaining the pressure distribution of refrigerant in which the indoor heat exchanger (condenser) is located on the high-pressure side and the outdoor heat exchanger (evaporator) is located on the low-pressure side as a result of the cooling operation even in the configuration in which the outdoor heat exchanger is divided. Thus, compared with a conventional case in which an operation is stopped and pressure is accordingly made uniform, an operation startup time can be reduced and power consumption can be reduced when heating is restarted.

It should be understood that the embodiments disclosed herein are illustrative and non-restrictive in every respect. It is therefore intended that the scope of the present invention is defined by claims, not only by the embodiments described above, and encompasses all modifications and variations equivalent in meaning and scope to the claims.

REFERENCE SIGNS LIST

1, 1A, 1B, 1C air conditioning system, 2, 2A, 2B, 2C outdoor unit, 3, 3A, 3B indoor unit, 10 compressor, 10*a* refrigerant inlet, 10*b* refrigerant outlet, 20, 20B indoor heat exchanger, 21 indoor fan, 40, 40B outdoor heat exchanger, 41 outdoor fan, 89-94, 94B, 95, 96, 96B, 98, 99, 100 pipe, 101, 102, 105 four-way valve, 103, 104 check valve, 110, 111, 111B LEV, 150, 150C cooling-heating switching mechanism, 161 bypass passage, 200 heat inter exchanger, 300 controller, E, F, G, H, P1-P6 port.

The invention claimed is:

1. An air conditioning system comprising:

a compressor having an entrance portion for suctioning refrigerant and an exit portion for discharging the refrigerant;

a first heat exchanger having a first port and a second port;

a second heat exchanger having a third port and a fourth port;

a first expansion valve configured to communicate between the second port and the third port;

a bypass passage configured to be at least a part of a flow passage connecting the third port to the entrance portion;

an on-off valve configured to switch a state of the bypass passage between communicated and non-communicated; and a cooling-heating switching mechanism connected to the entrance portion, the exit portion, the first port, and the fourth port, the cooling-heating switching mechanism including a first check valve having a first inlet and a first outlet, the first inlet communicating with the first port, a second check valve having a second inlet and a second outlet, the second outlet communicating with the first port, a first three-way valve configured to cause the first outlet to communicate with one of the entrance portion and the exit portion, and a four-way valve configured to cause the second inlet to communicate with one of the entrance portion and the exit portion and cause the fourth port to communicate with the other of the entrance portion and the exit portion.

2. The air conditioning system according to claim 1, further comprising a controller configured to control the compressor, the first expansion valve, the on-off valve, the first three-way valve, and the four-way valve, wherein when a defrosting operation of the second heat exchanger is performed, the controller is configured to close the first expansion valve, open the on-off valve, control the four-way valve to cause the second inlet to communicate with the entrance portion and cause the fourth port to communicate with the exit portion, control the first three-way valve to cause the first outlet to communicate with the exit portion, and operate the compressor.

3. The air conditioning system according to claim 2, wherein when stopping an operation of the air conditioning system during a cooling operation, the controller is configured to close the first expansion valve, close the on-off valve, control the four-way valve to cause the second inlet to communicate with the entrance portion and cause the fourth port to communicate with the exit portion, control the first three-way valve to cause the first outlet to communicate with the exit portion, and stop an operation of the compressor.

4. The air conditioning system according to claim 2, wherein when stopping an operation of the air conditioning system during a heating operation, the controller is configured to close the first expansion valve, close the on-off valve, control the four-way valve to cause the second inlet to communicate with the exit portion and cause the fourth port to communicate with the entrance portion, control the first three-way valve to cause the first outlet to communicate with the exit portion, and stop an operation of the compressor.

5. The air conditioning system according to claim 1, further comprising a third heat exchanger configured to perform heat exchange between refrigerant flowing through the bypass passage and refrigerant flowing through a flow passage between the third port and the first expansion valve.

6. The air conditioning system according to claim 1, wherein the compressor, the second heat exchanger, the bypass passage, the on-off valve, and the cooling-heating switching mechanism are housed in an outdoor unit, the first heat exchanger and the first expansion valve are housed in a first indoor unit, and the air conditioning system further comprises a second indoor unit connected in parallel with the first indoor unit with respect to the outdoor unit and having a fourth heat exchanger and a second expansion valve.

7. The air conditioning system according to claim 1, further comprising a fifth heat exchanger having a fifth port and a sixth port, the fifth port communicating with the third port, wherein the cooling-heating switching mechanism further includes a second three-way valve configured to cause the sixth port to communicate with one of the entrance portion and the exit portion.

8. The air conditioning system according to claim 7, further comprising a controller configured to control the compressor, the first expansion valve, the on-off valve, the first three-way valve, the second three-way valve, and the four-way valve, wherein when a defrosting operation of the second heat exchanger is preformed, the controller is configured to close the first expansion valve, open the on-off valve, control the four-way valve to cause the second inlet to communicate with the entrance portion and cause the fourth port to communicate with the exit portion, control the first three-way valve to cause the first outlet to communicate with the exit portion, control the second three-way valve to cause the sixth port to communicate with the entrance portion, and operate the compressor.

9. The air conditioning system according to claim 8, wherein when a defrosting operation of the fifth heat exchanger is performed, the controller is configured to close the first expansion valve, open the on-off valve, control the four-way valve to cause the second inlet to communicate with the exit portion and cause the fourth port to communicate with the entrance portion, control the first three-way valve to cause the first outlet to communicate with the exit portion, control the second three-way valve to cause the sixth port to communicate with the exit portion, and operate the compressor.

10. The air conditioning system according to claim 7, farther comprising a controller configured to control the compressor, the first expansion valve, the on-off valve, the first three-way valve, the second three-way valve, and the four-way valve, wherein when stopping an operation of the air conditioning system during a cooling operation, the controller is configured to close the first expansion valve, close the on-off valve, control the four-way valve to cause the second inlet to communicate with the entrance portion and cause the fourth port to communicate with the exit portion, control the first three-way valve to cause the first outlet to communicate with the exit portion, control the second three-way valve to cause the sixth port to communicate with the exit portion, and stop an operation of the compressor.

11. The air conditioning system according to claim 7, further comprising a controller configured to control the compressor, the first expansion valve, the on-off valve, the first three-way valve, the second three-way valve, and the four-way valve, wherein when stopping an operation of the air conditioning system during a heating operation, the controller is configured to close the first expansion valve, close the on-off valve, control the four-way valve to cause the second inlet to communicate with the exit portion and cause the fourth port to communicate with the entrance portion, control the first three-way valve to cause the first outlet to communicate with the exit portion, control the second three-way valve to cause the sixth port to communicate with the exit portion, and stop an operation of the compressor.

* * * * *